US007441773B2

(12) United States Patent
Kasahara et al.

(10) Patent No.: US 7,441,773 B2
(45) Date of Patent: Oct. 28, 2008

(54) IMAGE FORMING SYSTEM HAVING PLURAL SHEET STACKERS AND IMAGE FORMING METHOD THEREOF

(75) Inventors: Seitaro Kasahara, Hachioji (JP); Toshio Shida, Higashiyamato (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 493 days.

(21) Appl. No.: 10/949,281

(22) Filed: Sep. 27, 2004

(65) Prior Publication Data

US 2005/0218587 A1 Oct. 6, 2005

(30) Foreign Application Priority Data

Mar. 31, 2004 (JP) ..... 2004-106791

(51) Int. Cl.
*B65H 39/10* (2006.01)
*B65H 29/00* (2006.01)

(52) U.S. Cl. ..... 271/287; 271/288; 271/279; 271/300

(58) Field of Classification Search ..... 271/279, 271/287, 288, 290, 298, 300, 301, 176; 399/403, 399/396, 405

See application file for complete search history.

(56) References Cited

U.S. PATENT DOCUMENTS 4,114,871 A * 9/1978 Botte ..... 271/290
5,013,027 A * 5/1991 Furukawa ..... 271/290
5,177,546 A 1/1993 Tsubo
5,202,738 A * 4/1993 Braswell et al. ..... 399/364
5,248,136 A 9/1993 Hamanaka
5,598,258 A * 1/1997 Sato et al. ..... 399/85
5,749,024 A 5/1998 Young
5,931,464 A * 8/1999 Shimizu et al. ..... 271/296
6,257,572 B1 * 7/2001 Yamada et al. ..... 271/305
6,430,377 B1 8/2002 Tsutsumi
6,502,818 B1 * 1/2003 Nonaka et al. ..... 271/258.01
7,011,306 B2 * 3/2006 Kato et al. ..... 271/256

FOREIGN PATENT DOCUMENTS

JP 61266285 11/1986
JP 2003305906 10/2003

* cited by examiner

*Primary Examiner*—Patrick Mackey
*Assistant Examiner*—Luis A Gonzalez
(74) *Attorney, Agent, or Firm*—Finnegan, Henderson, Farabow, Garrett & Dunner, L.L.P.

(57) ABSTRACT

An image forming system includes: a first and second stacking sections arranged at a position different from each other for stacking a sheet with an image formed thereon by an image forming section; a first conveyance path and a second conveyance path longer than the first one for conveying the sheet to the first and second stacking sections, respectively through a common conveyance path, wherein an interval between sheets fed along the common conveyance path is smaller than the difference between the second and first conveyance paths; a switching section for switching a conveyance path of the sheet conveyed along the common conveyance path between the first and second conveyance paths; and a control device controls such that an (N+1)th sheet is stacked on the first stacking section after the N-th sheet has been stacked on the second stacking section.

28 Claims, 23 Drawing Sheets

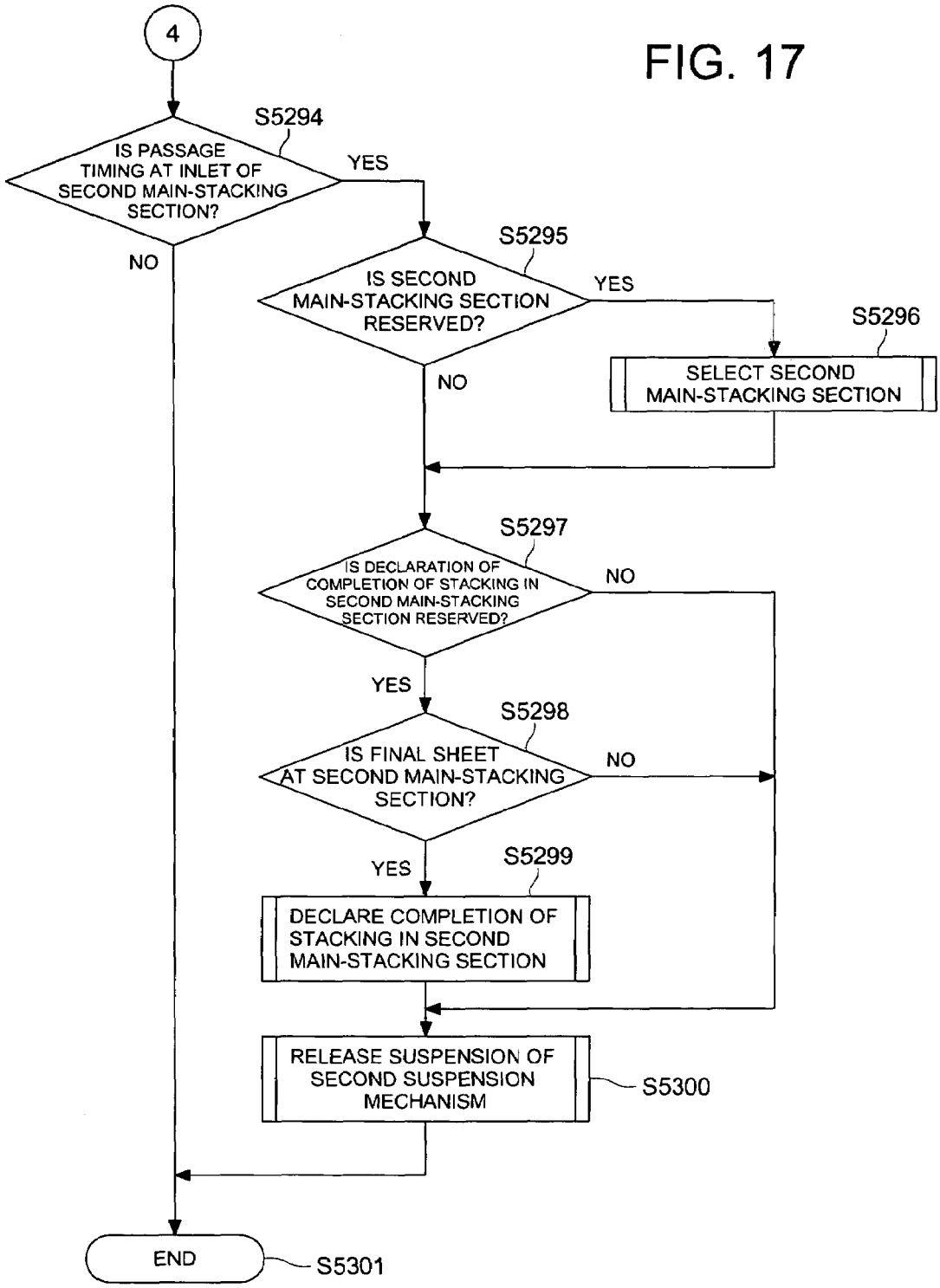
4
FIG. 17
S5294
IS PASSAGE TIMING AT INLET OF SECOND MAIN-STACKING SECTION?
YES
NO
S5295
IS SECOND MAIN-STACKING SECTION RESERVED?
YES
NO
S5296
SELECT SECOND MAIN-STACKING SECTION
S5297
IS DECLARATION OF COMPLETION OF STACKING IN SECOND MAIN-STACKING SECTION RESERVED?
NO
YES
S5298
IS FINAL SHEET AT SECOND MAIN-STACKING SECTION?
NO
YES
S5299
DECLARE COMPLETION OF STACKING IN SECOND MAIN-STACKING SECTION
RELEASE SUSPENSION OF SECOND SUSPENSION MECHANISM
S5300
END
S5301

IMAGE FORMING SYSTEM HAVING PLURAL SHEET STACKERS AND IMAGE FORMING METHOD THEREOF

BACKGROUND OF THE INVENTION

The present invention relates to an image forming system and image forming method, particularly to an image forming system having a plurality of stackers and image forming method thereof.

In a widely known image forming apparatus, after an image has been formed on many sheets of paper, these sheets are separated into groups each consisting of a predetermined numbers of sheets, and are stacked. Such an image forming apparatus comprises an image forming section for forming an image on paper, and a stacking unit for separating the sheets of paper fed out of the image forming section, into several groups each consisting of a predetermined numbers of sheets, and are stacked (for example, see Patent Document 1 which represents Official Gazette of Japanese Patent Tokkaihei 5-155177 corresponding to U.S. Pat. No. 5,248,136). The stacking unit uses a sorter-based stacker, described in the Patent Document 1, for sorting a predetermined number of the sheets of paper as a single stacking unit, or a stacker designed merely for stacking a predetermined number of sheets, whereby these sheets are separated into groups each consisting of a predetermined numbers of sheets. To put it another way, when a sorter-based stacker is used, the destination of the sheets is switched to another bin after a predetermined number of sheets have been loaded in one bin, thereby allowing the sheets to be separated into groups consisting of a predetermined number of sheets and to be stacked. In the meantime, when a plurality of the stackers designed merely for stacking is used, the destination of the sheets is switched to another stacker designed merely for stacking after a predetermined number of sheets have been loaded in one of these stackers, thereby allowing the sheets to be separated into groups consisting of a predetermined number of sheets and to be stacked.

If a jam such as a paper jam has occurred-on conveyance unit side, the jammed paper must be removed. Normally, an image is recorded on this paper, so image formation subsequent to clearing the jammed paper is restarted from the paper having been removed. This arrangement allows the sheets of paper to be stacked, without the order being affected, even after clearing of the jammed paper.

Since there is an increasing demand for higher speed in recent years, an image forming apparatus has been developed to reduce the timed intervals for conveyance of sheets and to minimize the loss of time in conveyance, wherein an image is formed continuously on a plurality of sheets. A higher speed can be achieved by reducing the timed interval for conveyance. However, if the timed interval for conveyance has been reduced below the difference in time (difference in conveyance time) between the time for conveying the paper to the destination closer to the image forming section (first destination) and the time for conveying it to the farther destination (second one), then the order of the sheets to be stacked may be disturbed. Such a failure will cause a jam when the destination of conveyance is switched from the first destination to the second one. This trouble is likely to occur when processing of clearing the jammed paper is carried out.

To put it in greater details, if the destination is switched after conveyance of the N-th sheet to the second destination, the (N+1)th and subsequent sheets are sent to the first destination. In this case if the interval timed for the conveyance is smaller than the difference in conveyance time, then the (N+1)th sheet will be sent to the first destination before the N-th sheet reaches the first destination and will be stacked in some cases. If this occurs, at least the (N+1)th sheet is stacked at the first destination even when paper has jammed at the second destination. When image formation is restarted after jammed paper has been cleared, the image will be formed sequentially on sheets, starting from the image corresponding to the n-th sheet. Since the image corresponding to (N+1)th sheet is formed on the new sheet even after the restart, the image corresponding to the (N+1)th sheet will be stacked in duplication. To prevent this duplication, not only the n-th sheet after clearing of jammed paper, but also the (N+1)th sheet stacked at the first destination must be removed. Such a procedure involves the correctly stacked sheet to be removed, and may make a user less willing to remove the paper or concerned about stacking after image formation. It will take a lot of time if an attempt is made to remove the duplicated sheet after checking against the original.

If the interval timed for conveyance is reduced by using a higher speed, the operation of switching section for conveyance to any one of the multiple stackers may not be terminated within the interval timed for conveyance.

SUMMARY OF THE INVENTION

The object of the present invention is to provide an effective way of avoiding disturbance of the order of stacking, resulting from use of a higher speed, thereby reducing the operator's burden. Another object of the present invention is to ensure complete switching of the destination of conveyance.

The aforementioned object of the present invention can be achieved by any one of the following Structures (1) through (28):

(1) An image forming system comprising: an image forming section for forming an image on a sheet; a first stacking section for stacking the sheet with an image formed thereon by the aforementioned image forming section; a second stacking section for stacking the sheet with an image formed thereon by the aforementioned image forming section, the second stacking section arranged at a position different from the first stacking section; a common conveyance path for conveying the sheet with an image formed thereon by the aforementioned image forming section; a first conveyance path for conveying the sheet conveyed along the aforementioned common conveyance path, to the first stacking section; a second conveyance path longer than the first one to convey the sheet conveyed along the aforementioned common conveyance path, to the second stacking section; and a switching section for switching a conveyance path of the sheet conveyed along the common conveyance path between the first conveyance path and the second conveyance path; wherein the interval between sheets fed along the aforementioned common conveyance path is smaller than the difference between the second and first conveyance paths, when images are formed on the sheets continuously one by one by the image forming section. This image forming system is further characterized by further comprising a control device that, when the switching section has been selected in such a way that the N-th sheet (N: natural number) with an image formed thereon is conveyed along the second conveyance path, and the (N+1)th sheet with an image formed thereon is conveyed along the first conveyance path during continuous image formation, controls in such a way that the (N+1)th sheet is stacked on the first stacking section after the N-th sheet has been stacked on the second stacking section.

According to the aforementioned Structure (1), when the switching section has been selected in such a way that the N-th sheet with an image formed thereon is conveyed along the second conveyance path and the (N+1)th sheet with an image formed thereon is conveyed along the first conveyance path, the (N+1)th sheet is stacked on the first stacking section after the N-th sheet has been stacked on the second stacking section. This arrangement ensures that the (N+1)th sheet is not stacked on the first stacking section, even if the N-th sheet has been jammed along the second conveyance path. To put it another way, the disturbance of stacking order can be avoided by controlling the order of subsequent image formation, even if image formation has restarted after a complicated jam clearing procedure of removing the jammed N-th sheet and the (N+1)th sheet remaining on the first conveyance path or common conveyance path without being stacked on the first stacking section. Thus, when clearing the sheet jam, this arrangement allows the operator to avoid disturbance of the order of stacking, merely by removing the N-th sheet having been jammed along the second conveyance path and the (N+1)th sheet remaining in the first conveyance path or common conveyance path, without removing the sheets stacked on the first conveyance destination or checking the order of stacking against the original.

(2) An image forming system described in Structure (1), further comprising a suspension mechanism for suspending a sheet on the common conveyance path or the first conveyance path, wherein the control device controls in such a way that the sheet is suspended in the suspension mechanism so that the (N+1)th sheet is stacked on the first stacking section, after the N-th sheet has been stacked on the second stacking section.

According to the aforementioned Structure (2), the (N+1) th sheet is stacked on the first stacking section, after the N-th sheet has been stacked on the second stacking section. Even if the image is recorded on the (N+1)th and subsequent sheets, they are prevented from being stacked on the first stacking section earlier than the N-th sheet.

(3) An image forming system described in Structure (2), wherein the aforementioned suspension mechanism suspends a sheet by stopping the conveyance of the (N+1)th sheet.

According to the aforementioned Structure (3), the sheet is suspended by stopping the conveyance of the (N+1)th sheet. This arrangement ensures the sheet to be suspended.

(4) An image forming system described in Structure (3), wherein the aforementioned suspension mechanism suspends the sheet by placing at least one of the (N+2)th and subsequent sheets on top of the (N+1)th sheet being suspended.

According to the aforementioned Structure (4), the suspension mechanism suspends the sheet by placing at least one of the (N+2)th and subsequent sheets on top of the (N+1)th sheet being suspended. This arrangement permits a plurality of sheets to be suspended.

(5) An image forming system described in Structure (2), wherein the aforementioned suspension mechanism suspends the sheet by decelerating the conveyance of the (N+1)th sheet.

According to the aforementioned Structure (5), the suspension mechanism suspends the sheet by decelerating the conveyance of the (N+1)th sheet. This method permits sheet to be suspended by a simple configuration.

(6) An image forming system described in Structure (1), wherein the control device controls in such a way that the interval between the N-th sheet and (N+1)th sheet will be greater than the interval between sheets fed continuously to one of the first and second stacking sections, whereby the (N+1)th sheet is stacked on the first stacking section after the N-th sheet has been stacked on the second stacking section.

According to the aforementioned Structure (6), the control device controls in such a way that the interval between the N-th sheet and (N+1)th sheet will be greater than the interval between sheets fed continuously to one of the first and second stacking sections, whereby the (N+1)th sheet is stacked on the first stacking section after the N-th sheet has been stacked on the second stacking section. This arrangement prevents the (N+1)th and subsequent sheets from being stacked on the first stacking section earlier than the N-th sheet, without installing the aforementioned suspension mechanism.

(7) An image forming system described in Structure (6), wherein the image forming section comprises a sheet storing section for storing a plurality of sheets, and a sheet feed section for feeding sheets one by one from the sheet storing section; and forms an image on the sheets fed out by the sheet feed section; while the control device controls the interval timed for the sheet feed section to feed the sheets in such a way that the interval between the N-th sheet and (N+1)th sheet will be greater than the interval between sheets fed continuously to one of the first and second stacking sections, whereby the (N+1)th sheet is stacked on the first stacking section after the N-th sheet has been stacked on the second stacking section.

According to the aforementioned Structure (7), the interval timed for the sheet feed section to feed the sheets is controlled in such a way that the interval between the N-th sheet and (N+1)th sheet will be greater than the interval between sheets fed continuously to one of the first and second stacking sections, whereby the (N+1)th sheet is stacked on the first stacking section after the N-th sheet has been stacked on the second stacking section. This arrangement allows the intervals between sheets to be provided adequately without modifying the control timing after feeding of the sheets.

(8) An image forming system described in Structures (1) through (7), wherein, when the N-th sheet is jammed along the second conveyance path, the control device stops the conveyance of the (N+1)th sheet, without permitting the (N+1)th sheet to be stacked on the first stacking section.

According to the aforementioned Structure (8), when N-th sheet is jammed along the second conveyance path, the control device stops the conveyance of sheet, without permitting the (N+1)th sheet to be stacked on the first stacking section. This arrangement allows image formation to be restarted from the image corresponding to the N-th sheet, after removing the N-th sheet having been jammed, and the (N+1)th sheet having been suspended in the first conveyance path or common conveyance path without being stacked on the first stacking section. Thus, sheets are stacked according to the order of stacking.

(9) An image forming system described in Structure (8), wherein, after clearing the sheet jam, the control device restarts image formation from the image corresponding to the N-th and subsequent sheets, and controls in such a way that the N-th sheet is stacked on the second stacking section and the (N+1)th sheet is stacked on the first stacking section.

According to the aforementioned Structure (9), the control device restarts image formation from the image corresponding to the N-th and subsequent sheets, and controls in such a way that the N-th sheet is stacked on the second stacking section and the (N+1)th sheet is stacked on the first stacking section. This arrangement ensures sheets to be stacked according to the order of stacking even if a sheet jam has occurred.

(10) An image forming system comprising: an image forming section for forming an image on a sheet; a first stacking section for stacking the sheet with an image formed thereon by the aforementioned image forming section; a second stacking section for stacking the sheet with an image formed thereon by the aforementioned image forming section, this second stacking section being arranged at a position different from the first stacking section; a common conveyance path for conveying the sheet with an image formed thereon by the aforementioned image forming section; a first conveyance path for conveying the sheet conveyed along the aforementioned common conveyance path, to the first stacking section; a second conveyance path longer than the first one to convey the sheet conveyed along the aforementioned common conveyance path, to the second stacking section; and a switching section for switching a conveyance path of the sheet conveyed along the common conveyance path between the first conveyance path and the second conveyance path; wherein the interval between sheets fed along the aforementioned common conveyance path is smaller than the difference between the second and first conveyance paths, when an image is formed on the sheets continuously one by one by the image forming section. This image forming system is characterized by further comprising a control device that controls in such a way that the intervals between the (N+1)th sheet and the N-th sheet are different, between; the case where the switching section has been selected in such a way that the N-th sheet (N: natural number) with an image formed thereon is conveyed along the second conveyance path, and the (N+1)th sheet with an image formed thereon is conveyed along the first conveyance path during continuous image formation; and the case where the switching section has been selected in such a way that the N-th sheet is conveyed along the first conveyance path, and the (N+1)th sheet is conveyed along the second conveyance path.

Normally whenever the N-th sheet is conveyed along the first conveyance path and the (N+1)th sheet is conveyed along the second conveyance path, the (N+1)th sheet is always stacked on the second stacking section after the N-th sheet has been stacked on the first stacking section, so there is no reversing of the order of stacking. However, when the N-th sheet is conveyed along the second conveyance path and the (N+1)th sheet is conveyed along the first conveyance path, the (N+1)th sheet is stacked on the first stacking section before the N-th sheet is stacked on the second stacking section, with the result that the order of stacking is reversed. Thus, reversing of the order of stacking can be prevented, if control is provided in such a way that the interval between the (N+1)th sheet and the N-th sheet is different, between the case where the switching section has been selected in such a way that the N-th sheet is conveyed along the second conveyance path, and the (N+1)th sheet is conveyed along the first conveyance path; and the case where the switching section has been selected in such a way that the N-th sheet is conveyed along the first conveyance path, and the (N+1)th sheet is conveyed along the second conveyance path, as described in Structure 10. To put it in greater details, setting is made to ensure the interval between the N-th sheet and (N+1)th sheet is longer where the switching section has been selected in such a way that the N-th sheet is conveyed along the second conveyance path, and the (N+1)th sheet is conveyed along the first conveyance path. Then after N-th sheet has been stacked on the second stacking section, the (N+1)th sheet is stacked on the first stacking section. Even if the N-th sheet is jammed along the second conveyance path, the (N+1)th sheet is not stacked in the first stacking section at this moment. In other words, even if image formation has restarted after clearing of the sheet jam, reversing of the order of stacking can be prevented by controlling the order of subsequent image formation. Thus, after clearing of the sheet jam, the operator can prevent the order of stacking from being reversed, merely by removing the (N+1)th sheet jammed along the second conveyance path and (N+1)th sheet suspended in the first conveyance path without being stacked on the first stacking section. In this case, the operator is not required to remove sheet stacked on the first destination or to check the order of stacking against the original.

(11) An image forming system comprising: an image forming section for forming an image on a sheet; a first stacking section for stacking the sheet with an image formed thereon by the aforementioned image forming section; a second stacking section for stacking the sheet with an image formed thereon by the aforementioned image forming section, this second stacking section being arranged at a position different from the first stacking section; a common conveyance path for conveying the sheet with an image formed thereon by the aforementioned image forming section; a first conveyance path for conveying the sheet conveyed along the aforementioned common conveyance path, to the first stacking section; a second conveyance path longer than the first one to convey the sheet conveyed along the aforementioned common conveyance path, to the second stacking section; and a switching section for switching a conveyance path of the sheet conveyed along the common conveyance path between the first conveyance path and the second conveyance path; wherein the interval between sheets fed along the aforementioned common conveyance path is smaller than the difference between the second and first conveyance paths, when an image is formed on the sheets continuously one by one by the image forming section. This image forming system is further characterized by comprising a control device that; when an image is formed on the continuous N-th sheet (N: natural number) and (N+1)th sheet and the switching section is selected in such a way that the N-th sheet is fed along the second conveyance path and the (N+1)th sheet is fed along the first conveyance path, and when image formation is restarted after sheet jam has been cleared when the N-th sheet is jammed along the second conveyance path and the (N+1)th sheet is ejected to the first stacking section; controls in such a way that; the aforementioned image forming section restarts image formation from the image corresponding to the N-th and subsequent sheets, except for the image that has already been formed on the (N+1)th sheet and ejected to the first stacking section; and the sheet with the image corresponding to the N-th sheet formed thereon is fed along the second conveyance path by the switching section.

According to the aforementioned Structure (11), when image formation is restarted after clearing of the jam of the N-th sheet having occurred along the second conveyance path and after ejection of the (N+1)th sheet to the first stacking section, the aforementioned image forming section restarts image formation from the image corresponding to the N-th and subsequent sheets, except for the image that has already been formed on the (N+1)th sheet ejected from the first stacking section. Accordingly, even if a sheet jam has occurred, this arrangement eliminates the possible duplication of the sheets with the same image formed thereon, after the sheet jam has been cleared. Thus, this arrangement ensures sheets to be stacked according to the order of stacking even if a sheet jam has occurred.

(12) An image forming system described in Structure (11), wherein the control device controls in such a way that, when the N-th sheet is jammed along the second conveyance path and a sheet with an image formed thereon is included in the (N+1)th and subsequent sheets, the image forming section is stopped after the sheet with an image formed thereon has been ejected to the first stacking section to ensure that the aforementioned sheet with an image formed thereon is not left behind along the common conveyance path or the first conveyance path.

According to the aforementioned Structure (12), if the N-th sheet is jammed along the second conveyance path and a sheet with an image formed thereon is included in the (N+1)th and subsequent sheets, the image forming section is stopped after the sheet has been ejected from the first stacking section to ensure that the sheet with an image formed thereon is not left behind along the first conveyance path. This arrangement prevents a new image from being formed on a sheet after a sheet jam occurs, and the sheet with an image formed thereon, included in the (N+1)th and subsequent sheets, is ejected to the first stacking section and is prevented from being left behind along the common and first conveyance paths.

(13) An image forming system described in Structure (11) or (12), wherein when the aforementioned switching section is selected in such a way that the N-th sheet is fed along the second conveyance path and the (N+1)th sheet is fed along the first conveyance path and when image formation is restarted after clearing of a sheet jam, in the event that the M sheets (M: natural number), with an image formed thereon before the N-th sheet is jammed along the second conveyance path and the image forming section is stopped, are ejected to the first stacking section; the control device controls in such a way that the control section restarts image formation from the image corresponding to the N-th sheet and (N+M+1)th and subsequent sheets; and the sheet with an image corresponding to the N-th sheet formed thereon by the switching section is fed to the second conveyance path; and the sheets with image corresponding to the (N+M+1)th and subsequent sheets are fed to the first conveyance path.

According to the aforementioned Structure (13), when image formation is restarted after clearing of a sheet jam, in the event that the M sheets (M: natural number), with an image formed thereon before the N-th sheet is jammed along the second conveyance path and the image forming section is stopped, are ejected to the first stacking section, the image forming section restarts image formation from the image corresponding to the (N+M+1)th and subsequent sheets. This arrangement prevents duplication of sheets with the same image formed thereon after clearing of sheet jam, without wasting M sheets with an image formed thereon before clearing of sheet jam.

(14) An image forming system comprising: an image forming section for forming an image on a sheet; a plurality of stacking sections for stacking the sheet with an image formed thereon by the aforementioned image forming section; a common conveyance path for conveying the sheet with an image formed thereon by the aforementioned image forming section; a plurality of conveyance paths leading from the common conveyance path to the multiple stacking sections; and a switching section for switching the conveyance paths of the sheet conveyed along the common conveyance path in order to convey the sheet conveyed by the common conveyance path to each of the multiple stacking sections; wherein control is provided in such a way that, when an image is formed on each sheet of sheet continuously by the image forming section, and the switching section is selected to ensure that the sheets up to the N-th sheet (N: natural number) with an image formed thereon and the (N+1)th and subsequent sheets with an image formed thereon are fed to different stacking sections, the interval between the N-th sheet and (N+1)th sheet is greater than that when sent to the same stacking section.

According to the aforementioned Structure (14), when the switching section is selected to ensure that the sheets up to the N-th sheet (N: natural number) with an image formed thereon and the (N+1)th and subsequent sheets with an image formed thereon are fed to different stacking sections, the interval between the N-th sheet and (N+1)th sheet is greater than that when sent to the same stacking section. This arrangement allows the interval between sheets of paper to be greater when the switching section is working than that when it is not working, and hence ensures a more reliable switching operation of the switching section.

(15) An image forming method used in an image forming system comprising: an image forming section for forming an image on a sheet; a first stacking section for stacking the sheet with an image formed thereon by the aforementioned image forming section; a second stacking section for stacking the sheet with an image formed thereon by the aforementioned image forming section, this second stacking section being arranged at a position different from the first stacking section; a common conveyance path for conveying the sheet with an image formed thereon by the aforementioned image forming section; a first conveyance path for conveying the sheet conveyed along the aforementioned common conveyance path, to the first stacking section; a second conveyance path longer than the first one to convey the sheet conveyed along the aforementioned common conveyance path, to the second stacking section; and a switching section for switching a conveyance path of the sheet conveyed along the common conveyance path between the first conveyance path and the second conveyance path; wherein the interval between sheets fed along the aforementioned common conveyance path is smaller than the difference between the second and first conveyance paths, when an image is formed on the sheets continuously one by one by the image forming section. This image forming method is further characterized in that, when the switching section is selected in such a way that the N-th sheet (N: natural number) with an image formed thereon during continuous image forming operation is fed along the second conveyance path and (N+1)th sheet is fed along the first conveyance path, the (N+1)th sheet is stacked on the first stacking section after the N-th sheet has been stacked on the second stacking section.

According to the aforementioned Structure (15), the same operation and effect as those in Structure (1) can be obtained.

(16) An image forming method described in Structure (15), wherein the aforementioned image forming system further comprises a suspension mechanism for suspending a sheet on the common conveyance path or the first conveyance path, wherein sheet is suspended in the suspension mechanism so that the (N+1)th sheet is stacked on the first stacking section, after the N-th sheet has been stacked on the second stacking section.

According to the aforementioned Structure (16), the same operation and effect as those in Structure (2) can be obtained.

(17) An image forming method described in Structure (16), wherein the aforementioned suspension mechanism suspends sheet by stopping the conveyance of the (N+1)th sheet.

According to the aforementioned Structure (17), the same operation and effect as those in Structure (3) can be obtained.

(18) An image forming method described in Structure (17), wherein the aforementioned suspension mechanism suspends the sheet by placing at least one of the (N+2)th and subsequent sheets on top of the (N+1)th sheet being suspended.

According to the aforementioned Structure (18), the same operation and effect as those in Structure (4) can be obtained.

(19) An image forming method described in Structure (16), wherein the aforementioned suspension mechanism suspends the sheet by decelerating the conveyance of the (N+1)th sheet.

According to the aforementioned Structure (19), the same operation and effect as those in Structure (5) can be obtained.

(20) An image forming method described in Structure (15), wherein the interval between the N-th sheet and (N+1)th sheet is greater than the interval between sheets fed continuously to one of the first and second stacking sections, whereby the (N+1)th sheet is stacked on the first stacking section after the N-th sheet has been stacked on the second stacking section.

According to the aforementioned Structure (20), the same operation and effect as those in Structure (6) can be obtained.

(21) An image forming method described in Structure (21), wherein the image forming section comprises a sheet storing section for storing a plurality of sheets, and a sheet feed section for feeding sheets one by one from the sheet storing section; and forms an image on the sheets fed out by the sheet feed section; while the interval timed for the sheet feed section to feed the sheets is controlled in such a way that the interval between the N-th sheet and (N+1)th sheet is greater than the interval between sheets fed continuously to one of the first and second stacking sections, whereby the (N+1)th sheet is stacked on the first stacking section after the N-th sheet has been stacked on the second stacking section.

According to the aforementioned Structure (21), the same operation and effect as those in Structure (7) can be obtained.

(22) An image forming method described in any one of the Structures (15) through (21), wherein, when the N-th sheet is jammed along the second conveyance path, the conveyance of the (N+1)th sheet is stopped, without permitting the (N+1)th sheet to be stacked on the first stacking section.

According to the aforementioned Structure (22), the same operation and effect as those in Structure (8) can be obtained.

(23) An image forming method described in the Structure (22), wherein, after clearing of the sheet jam, image formation is restarted from the image corresponding to the N-th and subsequent sheets, and the N-th sheet is stacked on the second stacking section and the (N+1)th sheet is stacked on the first stacking section.

According to the aforementioned Structure (23), the same operation and effect as those in Structure (9) can be obtained.

(24) An image forming method used in an image forming system comprising: an image forming section for forming an image on a sheet; a first stacking section for stacking the sheet with an image formed thereon by the aforementioned image forming section; a second stacking section for stacking the sheet with an image formed thereon by the aforementioned image forming section, this second stacking section being arranged at a position different from the first stacking section; a common conveyance path for conveying the sheet with an image formed thereon by the aforementioned image forming section; a first conveyance path for conveying the sheet conveyed along the aforementioned common conveyance path, to the first stacking section; a second conveyance path longer than the first one to convey the sheet conveyed along the aforementioned common conveyance path, to the second stacking section; and a switching section for switching a conveyance path of the sheet conveyed along the common conveyance path between the first conveyance path and the second conveyance path; wherein the interval between sheets fed along the aforementioned common conveyance path is smaller than the difference between the second and first conveyance paths, when an image is formed on the sheets continuously one by one by the image forming section. This image forming method is further characterized in that: when images are formed on the continuous N-th sheet (N: natural number) and (N+1)th sheet, and the switching section is selected in such a way that the N-th sheet is fed along the second conveyance path and the (N+1)th sheet is fed along the first conveyance path, and when image formation is restarted after sheet jam has been cleared when the N-th sheet is jammed along the second conveyance path and the (N+1)th sheet is ejected to the first stacking section; the aforementioned image forming section restarts image formation from the image corresponding to the N-th and subsequent sheets, except for the image that has already been formed on the (N+1)th sheet ejected to the first stacking section; and the sheet with the image corresponding to the N-th sheet formed thereon is fed along the second conveyance path by the switching section.

According to the aforementioned Structure (24), the same operation and effect as those in Structure (11) can be obtained.

(25) An image forming method described in the Structure (24), wherein, if the N-th sheet is jammed along the second conveyance path and a sheet with an image formed thereon is included in the (N+1)th and subsequent sheets, the image forming section is stopped after the sheet included in the (N+1)th and subsequent sheets has been ejected to the first stacking section to ensure that the aforementioned sheet included in the (N+1)th and subsequent sheets is not left behind along the first conveyance path.

According to the aforementioned Structure (25), the same operation and effect as those in Structure (12) can be obtained.

(26) An image forming method described in the Structure (24) or (25), wherein, when the aforementioned switching section is selected in such a way that the N-th sheet is fed along the second conveyance path and the (N+1)th sheet is fed along the first conveyance path; and when image formation is restarted after clearing of a sheet jam, in the event that the M sheets (M: natural number), with an image formed thereon before the N-th sheet is jammed along the second conveyance path and the image forming section is stopped, are ejected to the first stacking section; the control section restarts image formation from the image corresponding to the N-th sheet and (N+M+1)th and subsequent sheets; and the sheet with an image corresponding to the N-th sheet formed thereon by the switching section is fed to the second conveyance path; and the sheets with image corresponding to the (N+M+1)th and subsequent sheets are fed to the first conveyance path.

According to the aforementioned Structure (26), the same operation and effect as those in Structure (13) can be obtained.

(27) An image forming method used in an image forming system comprising: an image forming section for forming an image on a sheet; a first stacking section for stacking the sheet with an image formed thereon by the aforementioned image forming section; a second stacking section for stacking the sheet with an image formed thereon by the aforementioned image forming section, this second stacking section being arranged at a position different from the first stacking section; a common conveyance path for conveying the sheet with an image formed thereon by the aforementioned image forming section; a first conveyance path for conveying the sheet conveyed along the aforementioned common conveyance path, to the first stacking section; a second conveyance path longer than the first one to convey the sheet conveyed along the aforementioned common conveyance path, to the second stacking section; and a switching section for switching a conveyance path of the sheet conveyed along the common conveyance path between the first conveyance path and the second conveyance path; wherein the interval between sheets fed along the aforementioned common conveyance path is smaller than the difference between the second and first conveyance paths, when an image is formed on the sheets continuously one by one by the image forming section. This image forming method is further characterized in that the interval between N-th sheet and (N+1)th sheet is different between the time when the switching section is selected in such a way that the N-th sheet (N: natural number) with an image formed thereon during continuous image forming operation is fed along the second conveyance path and (N+1) th sheet is fed along the first conveyance path, and the time when the switching section is selected in such a way that the N-th sheet is fed along the first conveyance path and (N+1)th sheet is fed along the second conveyance path.

According to the aforementioned Structure (27), the same operation and effect as those in Structure (13) can be obtained.

(28) An image forming method used in an image forming system comprising: an image forming section for forming an image on a sheet; a plurality of stacking sections for stacking the sheet with an image formed thereon by the aforementioned image forming section; a common conveyance path for conveying the sheet with an image formed thereon by the aforementioned image forming section; a plurality of conveyance paths leading from the common conveyance path to the multiple stacking sections; and a switching section for switching the conveyance paths of the sheet conveyed along the common conveyance path in order to convey the sheet conveyed by the common conveyance path to each of the multiple stacking sections; wherein control is provided in such a way that, when an image is formed on each sheet continuously by the image forming section, and the switching section is selected to ensure that the sheets up to the N-th sheet (N: natural number) with an image formed thereon and the (N+1)th and subsequent sheets with an image formed thereon are fed to different stacking sections, the interval between the N-th sheet and (N+1)th sheet is greater than that when sent to the same stacking section.

According to the aforementioned Structure (28), the same operation and effect as those in Structure (14) can be obtained.

Thus, according to the present invention, even if the N-th sheet is jammed along the second conveyance path, the (N+1) th sheet is not left being on the first stacking section. In other words, even if image formation is restarted after removal of the jammed N-th sheet and the (N+1)th sheet remaining along the common conveyance path without being stacked on the first stacking section, the correct order of stacking is kept by controlling the order of image formation. This arrangement allows the operator to avoid disturbance of the order of stacking, merely by removing the N-th sheet having been jammed along the second conveyance path and the (N+1)th sheet remaining in the first conveyance path or common conveyance path, without removing the sheets stacked on the first conveyance destination or checking the order of stacking against the original.

When image formation is restarted after clearing of the jam of the N-th sheet having occurred along the second conveyance path and after ejection of the (N+1)th sheet to the first stacking section, the aforementioned image forming section restarts image formation from the image corresponding to the N-th and subsequent sheets, except for the image that has already been formed on the (N+1)th sheet ejected from the first stacking section. Accordingly, even if a sheet jam has occurred, this arrangement eliminates the possible duplication of the sheets with the same image formed thereon, after the sheet jam has been cleared. Thus, this arrangement ensures sheets to be stacked according to the order of stacking even if a sheet jam has occurred, and prevents the order of stacking from being disturbed while reducing the operator workload.

The interval between sheets is increased during the operation of the switching section as compared to other cases. This arrangement ensures a reliable switching operation of the switching section.

BRIEF DESCRIPTION OF THE DRAWINGS

FIG. 17 is a flowchart representing the continuation of the control of the inlets of the first and second main stacking sections shown in FIG. 16;

DETAILED DESCRIPTION OF THE PREFERRED EMBODIMENT

Embodiment 1

Figure 1:
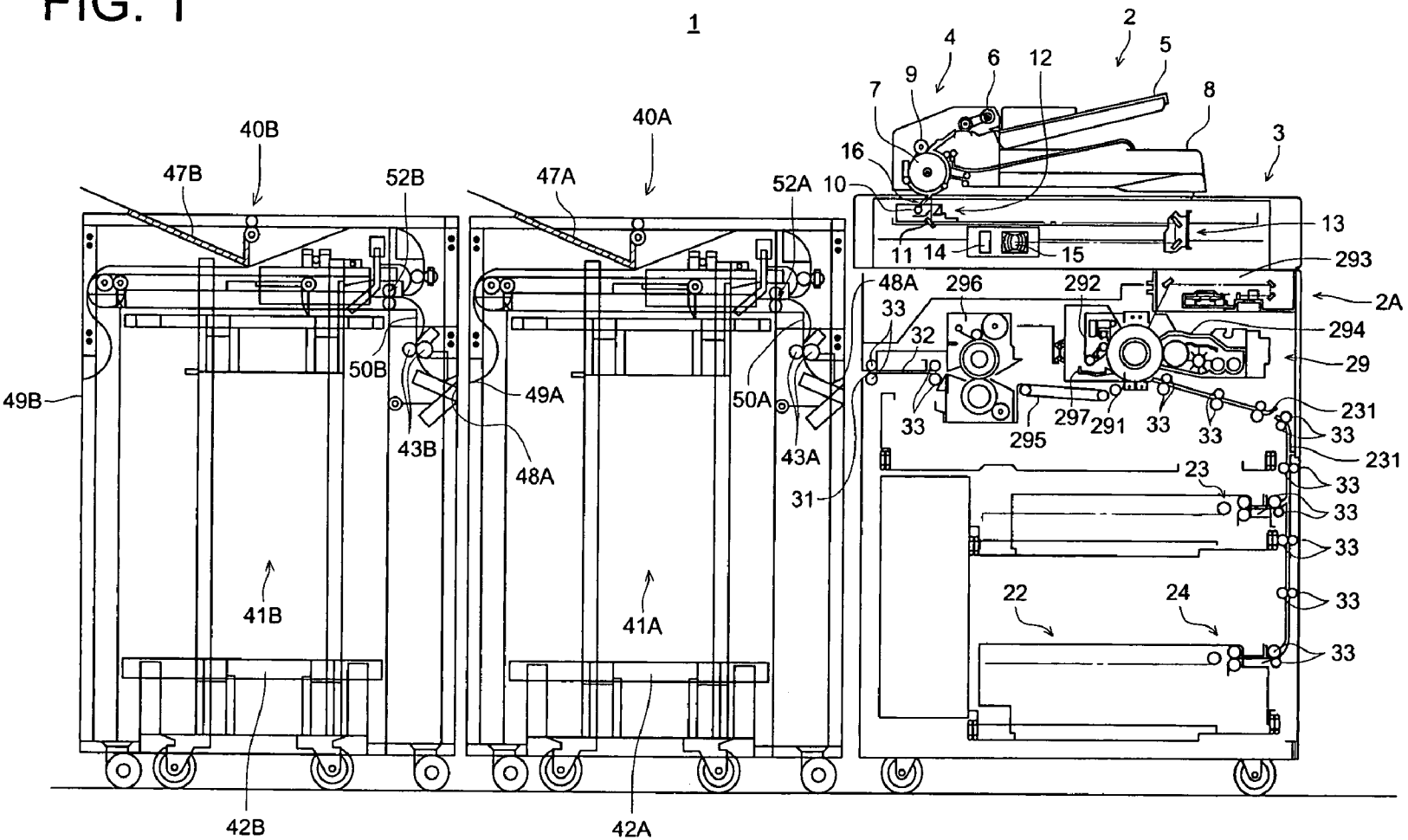
FIG. 1 is a side view of the schematic configuration of an image forming system of the present invention.
Figure 2:
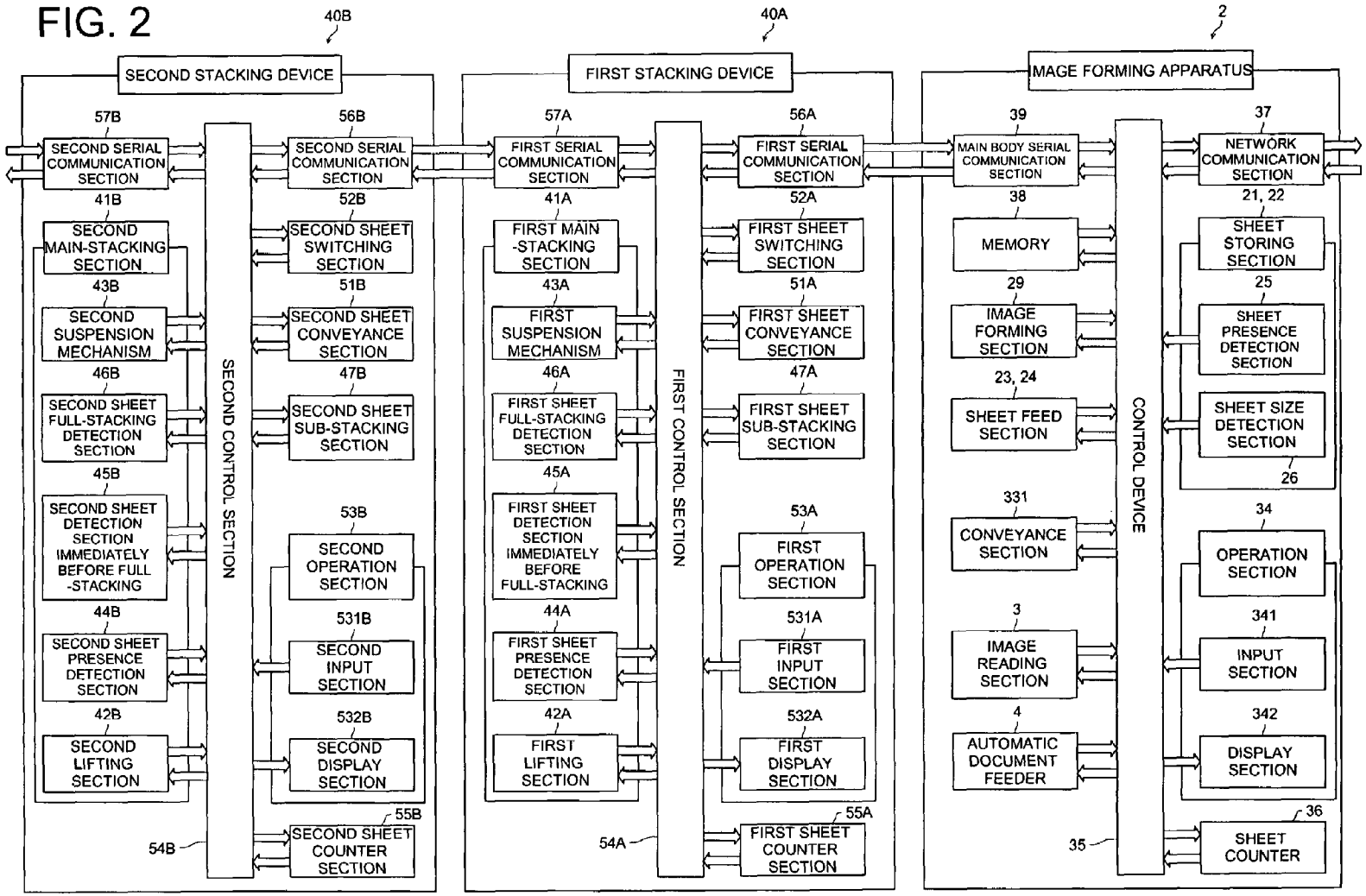
FIG. 2 is a block diagram representing the main control configuration of an image forming system given in FIG. 1.

Referring to the drawings, the following describes an image forming system as a first embodiment, without the present invention being restricted thereby. FIG. 1 is a side view of the schematic configuration of an image forming system, and FIG. 2 is a block diagram representing the main control configuration of the image forming system.

As shown in FIG. 1, the image forming system 1 includes an image forming apparatus 2 for recording an image on paper (in the form of a sheet) P; a first stacking device 40A, arranged close to the image forming apparatus 2, for stacking the paper P fed from the image forming apparatus 2; and a second stacking device 40B, arranged farther than the first stacking device 40A, for stacking the paper P fed through the first stacking device 40A.

In the first place, the following describes the image forming apparatus 2. The image forming apparatus 2 has an image forming apparatus proper 2A for forming an image on paper P. An image reading section 3 for scanning from a document an image to be formed on paper P is provided on the image forming apparatus proper 2A. The image reading section 3 is equipped with an automatic document feeder 4 that automatically feeds the document to the image reading section 3.

The automatic document feeder 4 has a document platen 5 on which the document is placed. One end of the document platen 5 is provided with a document feed roller 6 for feeding the documents one by one. A document support roller 7 for supporting and rotating the document is arranged below the document platen 5. A document ejection platen 8 for ejecting the document scanned by the image reading section 3 is arranged below the document platen 5. Further, a document conveying roller 9 is arranged inside the automatic document feeder 4. This roller is intended to convey the document fed from the document platen 5, to the upper portion on the peripheral surface of the document support roller 7, and to eject the document conveyed along the peripheral surface of the document support roller 7, to the document ejection platen 8.

The image reading section 3 comprises a first mirror unit 12 composed integrally of a light source 10 for applying light to the document and a mirror 11 for reflecting the light reflected from the document; and a second mirror unit 13 for further reflecting the light from the first mirror unit 12. The mirror units 12 and 13 are arranged in the lateral direction as viewed from FIG. 1. The image reading section 3 consists of a CCD (charge coupled device), for example, and is provided with an image-capturing device 14. A lens 15 is arranged on the front of the image-capturing device 14 so that the light coming from the second mirror unit 13 will form an image on an image forming device.

A slit 16 is provided below the document support roller 7 to apply light to the document fed along the document support roller 7. The image reading section 3 reads the image by allowing the first mirror unit 12 to be placed below the slit 16. Further, the automatic document feeder 4 is arranged to be freely opened or closed with respect to the image reading section 3. A platen glass for placing the document thereon is arranged on the upper surface of the image reading section 3. The image reading section 3 allows the first and second mirror units 12 and 13 to scan the document placed on the platen glass, thereby reading the image.

Two sheet storing sections 21 and 22 for storing a plurality of sheets of paper P in stacks are arranged in two upper and lower stairs downward inside the image forming apparatus proper 2A. The sheet feed sections 23 and 24 for feeding the sheets of paper P for recording an image thereon, one by one from sheet storing sections 21 and 22 are arranged on the ends of these sheet storing sections 21 and 22, respectively. Further, the sheet storing sections 21 and 22 is equipped with a sheet presence detecting section 25 for detecting the presence or absence of paper P and a sheet size detection section 26 for detecting the size (See FIG. 2).

An image forming section 29 is mounted above the sheet storing sections 21 and 22. The image forming section 29 has a cylindrical photoconductor drum 291, which is driven in the clockwise direction in FIG. 1 by a drum drive mechanism (not illustrated).

A charging section 292 is arranged in the vicinity of the upper peripheral surface of the photoconductor drum 291. The charging section 292 applies corona charging to the surface of the photoconductor drum 291, so that the surface of the photoconductor drum 291 is uniformly charged.

An exposure section 293 is arranged around the photoconductor drum 291 and on the downstream side in the rotating direction of the photoconductor drum 291 from the charging section 292, where a laser, for example, is used as a light source for exposure. The exposure section 293 applies image exposure to the surface of the photoconductor drum 291 based on the image signal, so that the electric charge on the surface of the photoconductor drum 291 of the exposed portion is damped and turned off to form an electrostatic latent image.

A development section 294 is arranged around the photoconductor drum 291 and on the downstream side in the rotating direction of the photoconductor drum 291 from the exposure section 293. The development section 294 ensures that the toner charged in the same polarity as the photoconductor drum 291 is attached to the electrostatic latent image on the surface of the photoconductor drum 291.

A transfer section 295 is arranged around the photoconductor drum 291 and on the downstream side in the rotating direction of the photoconductor drum 291 from the development section 294. A conveyance path for conveying paper P is arranged between the transfer section 295 and photoconductor drum 291. The transfer section 295 allows the paper P to be charged as the paper P is pressed against the photoconductor drum 291, so that toner is attracted to the paper P and is transferred thereon. At the same time, the transfer section 295 eliminates electric charge from the charged paper P so that paper P is detached from the photoconductor drum 291.

A fixing section 296 is arranged downstream from the transfer section 295 along the paper P conveyance path, and toner melted by heat is fixed on paper P by the fixing section 296 so that the toner image is fixed onto the paper P.

A cleaning section 297 for removing and cleaning the residual toner pressed against the surface of the photoconductor drum 291 is arranged around the photoconductor drum 291 and on the downstream side in the rotating direction of the photoconductor drum 291 from the transfer section 295.

An ejection port 31 for ejecting the paper P with an image formed thereon is arranged on the side of the image forming apparatus 2.

The image forming apparatus 2 incorporates a sheet feed conveyance path 231 for conveying the paper P supplied from the sheet storing sections 21 and 22, to the image forming section 29, and a common conveyance path 32 for conveying the paper P with an image formed thereon by the image forming section 29, to the ejection port 31. The image forming apparatus 2 is equipped with a sheet conveyance section 331 for giving thrust to the paper P inside the sheet feed conveyance path 231 and common conveyance path 32 and conveying that paper, by means of a plurality of pairs of rollers 33 arranged at predetermined positions along the sheet feed conveyance path 231 and common conveyance path 32 (See FIG. 2).

As shown in FIG. 2, the image forming apparatus 2 is provided with an operation section 34 for operating the image forming apparatus 2. The operation section 34 is a touch panel, for example, and consists of an input section 341 for inputting various instructions therein and a display section 342 for displaying such states of image formation as the number of sheets on which an image is formed and the size of sheets, as well as various instructions.

Further, the image forming apparatus 2 is provided with a control device 35. The control device 35 is electrically connected with a sheet feed sections 23 and 24, an image forming section 29, an input section 341, a display section 342, a sheet conveyance section 331, a sheet counter 36 for counting the number of sheets on which an image is formed, a network communication section 37 for connection with various communication circuits, a memory 38 for storing the image data inputted from the network communication section 37, the count by the sheet counter 36 and control program, and a main body serial communication section 39 connected to the first stacking device 40A. The control device 35 is further connected with various drives of the image forming apparatus 2. The control device 35 controls various devices according to the control program and control data stored in the memory 38.

In the present embodiment, a photosensitive image forming apparatus has been illustrated as an example of the image forming apparatus 2. However, any form of image forming apparatus can be used only if an image can be formed on paper P. Other examples of an image forming apparatus include a thermal type, inkjet printer type or laser type image forming apparatus. The image forming apparatus 2 can be a printer, a copier, a fax or a combination of these.

Figure 3:
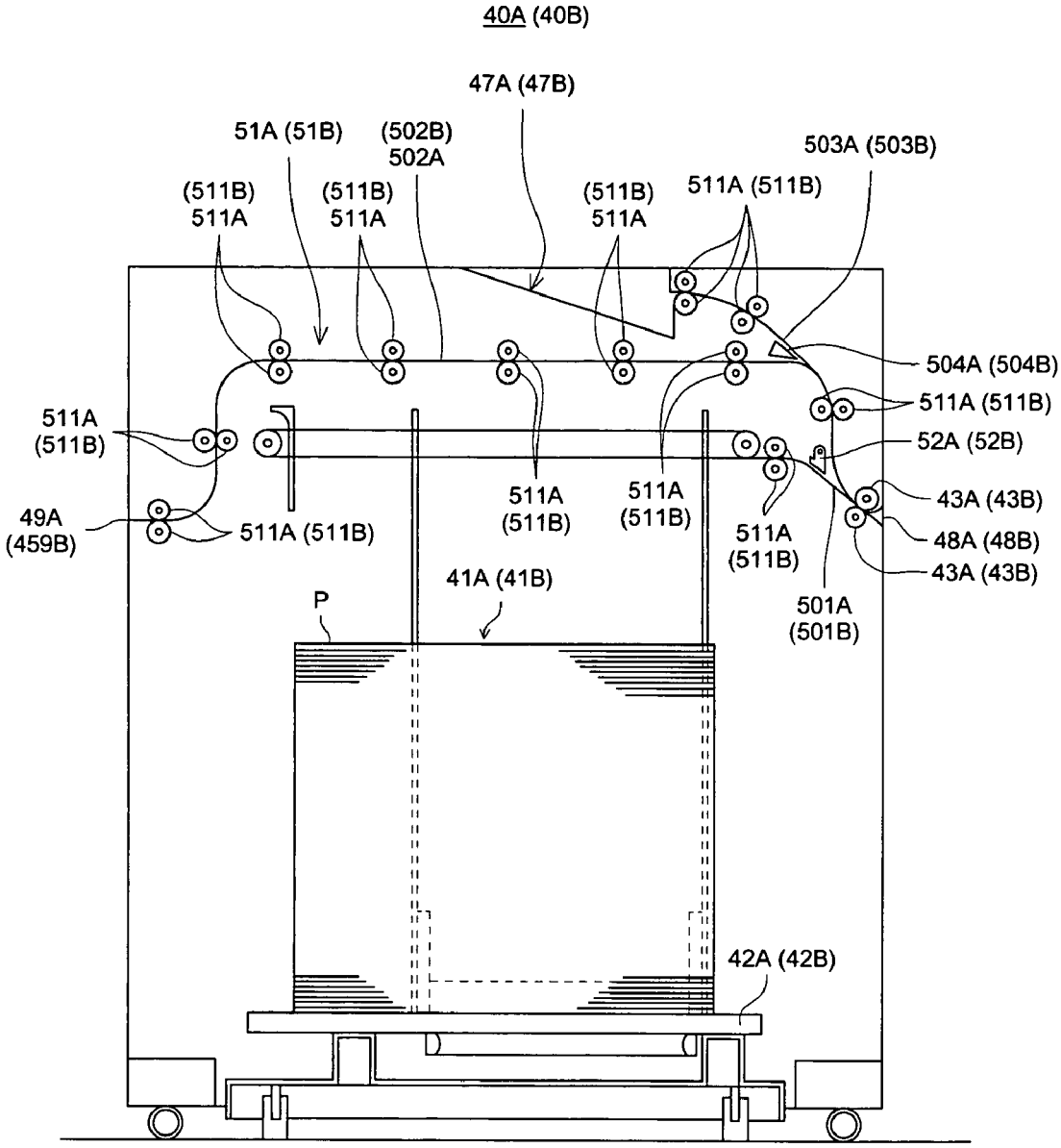
FIG. 3 is a side view of the schematic configuration of first and second stacking devices of an image forming system given in FIG. 1.

The following describes the first stacking device 40A. FIG. 3 is a side view of the schematic configuration of the printing section 40.

As shown in FIGS. 1 and 3, the first stacking device 40A incorporates a first main-stacking section 41A where the sheets of paper P are stacked. The first main-stacking section 41A includes a first lifting section 42A freely movable in the vertical direction. When unloaded, the first lifting section 42A is located at the topmost position, and is lowered as the sheets of paper P are stacked. It goes upward when the stacked sheets of paper P have been removed. The first lifting section 42A is equipped with a first sheet presence detection section 44A for detecting if paper A is present or not; a first sheet detection section immediately before full-stacking 45A for detecting that the first stacking section is filled with paper to the level immediately before fully stacked level; and first sheet full-stacking detection section 46A for detecting that the first stacking section is loaded to the fully stacked level (see FIG. 2).

To control the vertical traveling of the first lifting section 42A, a detecting means is provided in the vicinity of the topmost position (not illustrated) to ensure that the first lifting section 42A is lowered to a predetermined level when the stacked sheets of paper P have been detected. Alternatively, control can be provided in such a way that the first lifting section 42A is lowered until paper P is no longer detected by the aforementioned detecting means. This lowering operation is repeated every time the sheet of paper P has been detected, and the first lifting section 42A travels upward when paper P has been removed.

A first sheet sub-stacking section 47A is arranged on the top of the first stacking device 40A to stack the sheets of paper P ejected outside the apparatus. Further, one side of the first stacking device 40A is connected with the ejection port 31 of the image forming apparatus 2. A first inlet 48A is provided on that side, while a first outlet 49A for ejecting the paper P is arranged on the other side. The first stacking device 40A incorporates a first stacking path 501A for conveying paper P from the first inlet 48A to the first main-stacking section 41A, a first ejection path 502A, branched off from the first stacking path 501A, for conveying paper P to the first outlet 49A, and a first sheet sub-path 503A, branched off from the first ejection path 502A, for conveying paper P to the first sheet sub-stacking section 47A. The branched portion of the first sheet sub-path 503A is equipped with a switching piece 504A for switching the destination between the first outlet 49A and first sheet sub-stacking section 47A.

A first sheet switching section 52A for switching between the stacking path or the first ejection path 502A to which paper P is to be conveyed is arranged where first ejection path 502A is branched off from the first stacking path 501A. This first sheet switching section 52A is used to switch among a plurality of stacking devices either the first stacking device or second stacking device (which will be described later) in the present embodiment. A common sheet conveyance path is formed of the path in the first stacking path 501A up to where the first ejection path 502A is branched off from the first inlet 48A by the first sheet switching section 52A, and the common conveyance path 32 of the image forming system 1. The first stacking path 501A, first ejection path 502A and first sheet sub-path 503A are provided with a first sheet conveyance section 51A for giving thrust to the paper P through a plurality of pairs of rollers 511A.

A first suspension mechanism 43A for suspending the paper P or conveying it is located between the first sheet switching section 52A in the first stacking path 501A and the first inlet 48A. This first suspension mechanism 43A is composed of a pair of rollers. When the rollers are stopped, the paper P can be suspended. In this case, the first suspension mechanism 43A is designed to ensure that more than one two sheets of paper P can be suspended one on top of another, and the sheets of paper P placed one on top of another can be conveyed by driving the rollers. The present embodiment shows the case where the first suspension mechanism 43A is located in the first stacking path 501A. However, the first suspension mechanism 43A can be arranged inside the common conveyance path 32.

As shown in FIG. 2, the first stacking device 40A is provided with a first operation section 53A. The first operation section 53A is a touch panel, and incorporates a first input section 531A through which various instructions are inputted, and a first display section 532A that displays the status of image formation such as the number of sheets of papers for image formation and paper size as the information set on the image forming system 1 (information on the JOB being currently executed), as well as various instructions.

The first stacking device 40A is provided with a first control section 54A. The first control section 54A is electrically connected with a first sheet switching section 52A, a first sheet conveyance section 51A, a first sheet sub-stacking section 47A, a first input section 531A, a first display section 532A, a first lifting section 42A, a first suspension mechanism 43A, a first sheet presence detection section 44A, a first sheet detection section immediately before full-stacking 45A, a first sheet full-stacking detection section 46A, a first sheet counter section 55A for counting the stacked sheets, and first serial communication sections 56A and 57A connected to the image forming apparatus 2 and second stacking device 40B. The first control section 54A is connected with the drive sections of the first stacking device 40A. The first control section 54A controls various sections in conformity to the control of the control device 35 of the image forming apparatus 2.

The following describes the second stacking device 40B. The second stacking device 40B has the same configuration as the first stacking device 40A. To avoid duplication, the following description omits reference to the same members as those of the first stacking device 40A, where the "first" of the name should be read as "second" and "A" as "B".

The second inlet 48B of the second stacking device 40B is connected with the first outlet 49A of the first stacking device 40A. This arrangement allows connection between the first ejection path 502A of the first stacking device 40A and the second stacking path 501B of the second stacking device 40B. To put it another way, the first sheet conveyance path of the present invention is composed of the first stacking path 501A, except for the portion leading from the first inlet 48A to the first sheet switching section 52A. The second sheet conveyance path is composed of the first ejection path 502A and second stacking path 501B.

As described above, since the length of the second sheet conveyance path is set greater than that of the first one, the paper P with an image formed thereon by the image forming section 29 is stacked on the first main-stacking section 41A in a shorter time than when it is stacked on the second main-stacking section 41B, provided that the conveyance speed is constant. In the present embodiment, the length of the second sheet conveyance path is set greater than that of the first one. In addition to the length, it is also possible to arrange such a configuration that the conveyance speed in the first sheet conveyance path is different from that in the second sheet conveyance path, so that the conveyance time for paper P to be stacked on the first main-stacking section 41A is shorter than the conveyance time for paper P to be stacked on the second main-stacking section 41B. In this case, the above-mentioned "conveyance time" can be the time obtained by dividing the lengths of the first and second sheet conveyance paths by conveyance speed in the second sheet conveyance path, or the measured time for the paper P simply to pass through the first and second sheet conveyance paths.

The present embodiment refers to the case where two stackers, namely the first stacking device 40A and second stacking device 40B are arranged in series. Nothing is connected to the second outlet 49B of the second stacking device 40B or the second serial communication section 57B. When a third stacking device is provided, the second outlet 49B and the second serial communication section 57B are connected with the inlet and serial communication section of the third stacking device.

The following describes the operation of the image forming system 1.

When an image formation instruction is inputted into the operation section 34, the control device 35 selects the sheet storing sections 21 and 22 where the result of detection by the sheet presence detecting section 25 is "present", and controls the sheet feed sections 23 and 24 of the selected sheet storing sections 21 and 22, as well as the sheet conveyance section 331 so that paper P passes through the sheet feed conveyance path 231 to reach the image forming section 29. In this case, when the image formation instruction for a plurality of sheets of paper P has been inputted in the operation section 34, the control device 35 continuously coveys the plurality of sheets of paper P at a predetermined timing. The interval timed for each of the sheets of paper P in the above-mentioned continuous conveyance mode is called interval for conveyance timing.

When the paper P has been sent to the image forming section 29, the control device 35 controls the image forming section 29, whereby the surface of the photoconductor drum 291 is uniformly charged by the charging device 292 and image is exposed by the exposure section 293. Based on the image data scanned by the image reading section 3, electrostatic latent image is formed, and toner is attached to this electrostatic latent image by the development section 294, whereby a toner image is formed.

When the toner image passes over the sheet conveyance path, the control device 35 allows the paper P to be conveyed at the interval timed for the paper P to be conveyed below the photoconductor drum 291, and permits the toner image to be transferred on the paper P by the transfer section 295. It also allows the toner image to be fixed thereon by the fixing section 296. The control device 35 then allows the paper P with an image formed thereon to pass through the common conveyance path 32 so that paper P is ejected from the ejection port 31. Then the residual toner on the surface of the photoconductor drum 291 is cleaned by the cleaning section 297 so that the system is ready for the next image formation.

When the paper P reaches the ejection port 31 after passing through the common conveyance path 32 and enters the first inlet 48A of the first stacking device 40A, the control device 35 issues a conveyance start instruction to the first control section 54A. This conveyance start instruction includes the information on the destination of the paper P selected from among the first main-stacking section 41A, first sheet sub-stacking section 47A, second main-stacking section 41B and second inlet 48B. If the second main-stacking section 41B and second sheet sub-stacking section 47B are selected as destinations, the control device 35 gives the conveyance start instruction to the first control section 54A, as well as the second control section 54B.

The following describes the cases where various destinations have been selected.

When the first main-stacking section 41A has been selected, the first control section 54A controls the first sheet switching section 52A and first sheet conveyance section 51A. After switching the destination over to the first main-stacking section 41A, the paper P coming from the first inlet 48A is conveyed. This arrangement causes the paper P to pass through the first sheet conveyance path to reach the first main-stacking section 41A. Upon termination of conveyance, the first control section 54A allows the first sheet counter 55A to be incremented by one.

When the first sheet sub-stacking section 47A has been selected, the first control section 54A controls the first sheet switching section 52A, first switching piece 504A and first sheet conveyance section 51A. After the destination has been switched over to the first sheet sub-stacking section 47A, paper P coming from the first inlet 48A is conveyed. Thus, paper P is fed from the first stacking path 501A to the first ejection path 502A. Then it travels along the first sheet sub-path 503A to reach the first sheet sub-stacking section 47A.

When the second main-stacking section 41B has been selected, the first control section 54A controls the first sheet switching section 52A and first sheet conveyance section 51A. After the destination is switched over to the first outlet 49A, the paper P coming from the first outlet 49A is conveyed. The paper P reaches the first outlet 49A and enters the second inlet 48B. Then the second control section 54B controls the second sheet switching section 52B and second sheet conveyance section 51B and switches the destination over to the second main-stacking section 41B. Then the paper P coming from the second inlet 48B is conveyed. Thus, the paper P passes through the second sheet conveyance path to reach the second main-stacking section 41B. Upon termination of conveyance, the second control section 54B allows the second sheet counter 55B to be incremented by one.

In this case, since the second main-stacking section 41B is located farther from the image forming section 29 than the first main-stacking section 41A, the time (second conveyance time) for the paper P to be conveyed from the image forming section 29 to the second main-stacking section 41B is longer than that (first conveyance time) for the paper P to be conveyed to the first main-stacking section 41A. The difference between the second and first conveyance time is referred to as conveyance time difference.

When the second sheet sub-stacking section 47B is selected, the first control section 54A controls the first sheet switching section 52A and the first sheet conveyance section 51A, and conveys the paper P coming from the first inlet 48A after the destination has been switched over to the first outlet 49A. When the paper P has reached the first outlet 49A and has entered the inlet 48B of the second stacking device 40B, the second control section 54B controls the second switching piece 504B and second sheet conveyance section 51B, and conveys the paper P coming from the second inlet 48B after the destination has been switched over to the second sheet sub-stacking section 47B. This arrangement allows the paper P to reach the second ejection path 502B from the first stacking path 501A and to enter the second stacking path 501B. The paper P enters the second sheet sub-path 503B after reaching the second ejection path 502B to the second stacking path 501B, and is then fed to the second sheet sub-stacking section 47B.

The following describes the timing of conveyance when the destination is switched. If image formation and conveyance are smooth and satisfactory, either the first main-stacking section 41A or second main-stacking section 41B is normally selected. When a predetermined number of sheets of paper P have been stacked on the first selected destination out of these two destinations, the destination is switched over to the other one.

With consideration given to removal of the paper, switching may be performed for an appropriate number of sheets or for each job.

Figure 4:
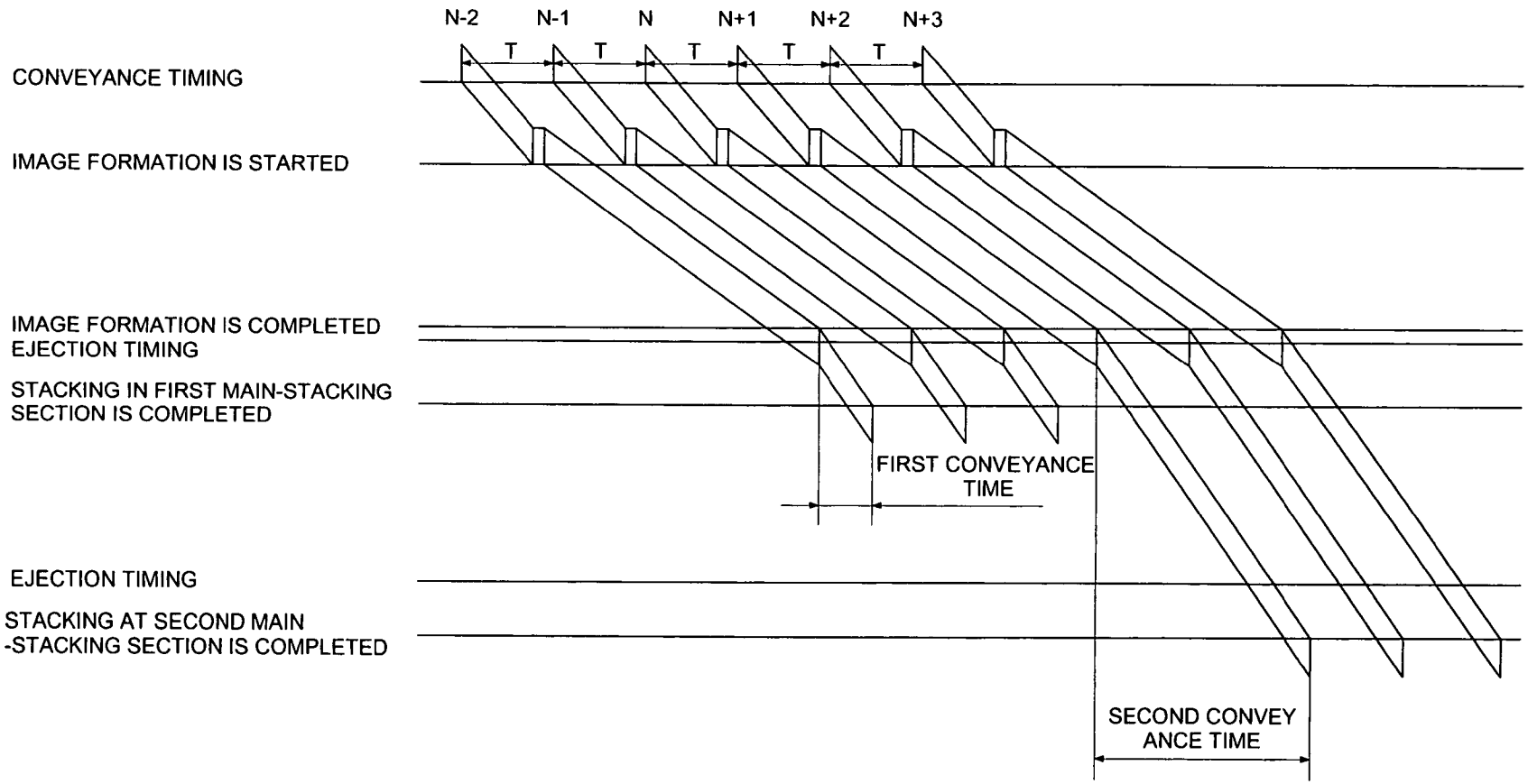
FIG. 4 is a timing chart representing the timing of conveyance when the conveyance destination after switching is farther than that before switching in an image forming system given in FIG. 1.

Referring to the FIG. 4, the following describes the case where the destination is switched over from the first main-stacking section 41A to the second main-stacking section 41B, i.e. where the destination subsequent to switching is located farther than that prior to switching: FIG. 4 is a timing chart representing the timing of conveyance. This timing chart indicates the timing for starting and terminating the image formation, ejection, and termination of stacking for each sheets of paper P, when a plurality of sheets of paper P are continuously conveyed from sheet storing sections 21 and 22 at a predetermined interval timed for conveyance T. For example, the sheets of paper P stacked on the first main-stacking section 41A are conveyed from the sheet storing sections 21 and 22 to the image forming section 29, and an image is formed on them by the image forming section 29. Then these sheets of paper are ejected from-the ejection port 31 of the image forming apparatus 2 to enter the first stacking device 40A, and are then stacked on the first main-stacking section 41A. Further, the sheets of paper P stacked on the second main-stacking section 41B are fed to the image forming section 29 from the sheet storing sections 21 and 22, and an image is formed on them by the image forming section 29. Then these sheets of paper are ejected from the ejection port 31 of the image forming apparatus 2. After passing through the first stacking device 40A, they enter the second stacking device 40B, and are then stacked on the second main-stacking section 41A.

The above-mentioned sheets of paper P are conveyed continuously to the sheet storing sections 21 and 22 at the interval timed for conveyance T. Since a higher image forming speed is gained by smaller interval timed for conveyance T, the interval timed for conveyance T is set smaller than the above-mentioned difference in conveyance time. When each of the sheets of paper P has reached the image forming section 29, image formation is initiated by the image forming section 29. Upon completion of image formation, paper P is ejected from the image forming apparatus 2 and is conveyed to the destination. In FIG. 4, (N−2)th, (N−1)th and N-th sheets. (N: a natural number) are stacked on the first main-stacking section 41A, and (N+1)th, (N+2)th and (N+3)th sheets are stacked on the second main-stacking section 41B. The N-th sheet P is the last to be stacked on the first main-stacking section 41A; then the destination is switched over to the second main-stacking section 41B. As shown in FIG. 4, (N+1)th and subsequent sheets of paper P are not stacked on the second main-stacking section 41B before the N-th sheet is stacked on the first main-stacking section 41A. Accordingly, if the N-th sheet P is jammed in the first sheet conveyance path when the destination is switched, the (N+1)th to (N+M)th sheet P (M: natural number) with an image formed thereon before the jam is detected and the image forming section 29 is stopped are left behind in the common conveyance path 32. Thus, in the clearing of the jammed paper, the N-th sheet P jammed in the first sheet conveyance path and the (N+1)th to (N+M)th sheet P left behind in the common conveyance path 32 must be removed. When image formation is restarted, the control device 35 allows images to be formed on the (N+M+1)th and subsequent sheets of paper P sequentially, starting from the image corresponding to the N-th sheet. The (N+M+1)th sheet P with an image corresponding to the N-th sheet formed thereon is stacked on the first main-stacking section 41A, and the (N+M+2)th sheet P with an image corresponding to the (N+1)th and subsequent sheets N-th sheet formed thereon are stacked on the second main-stacking section 41B.

Figure 12:
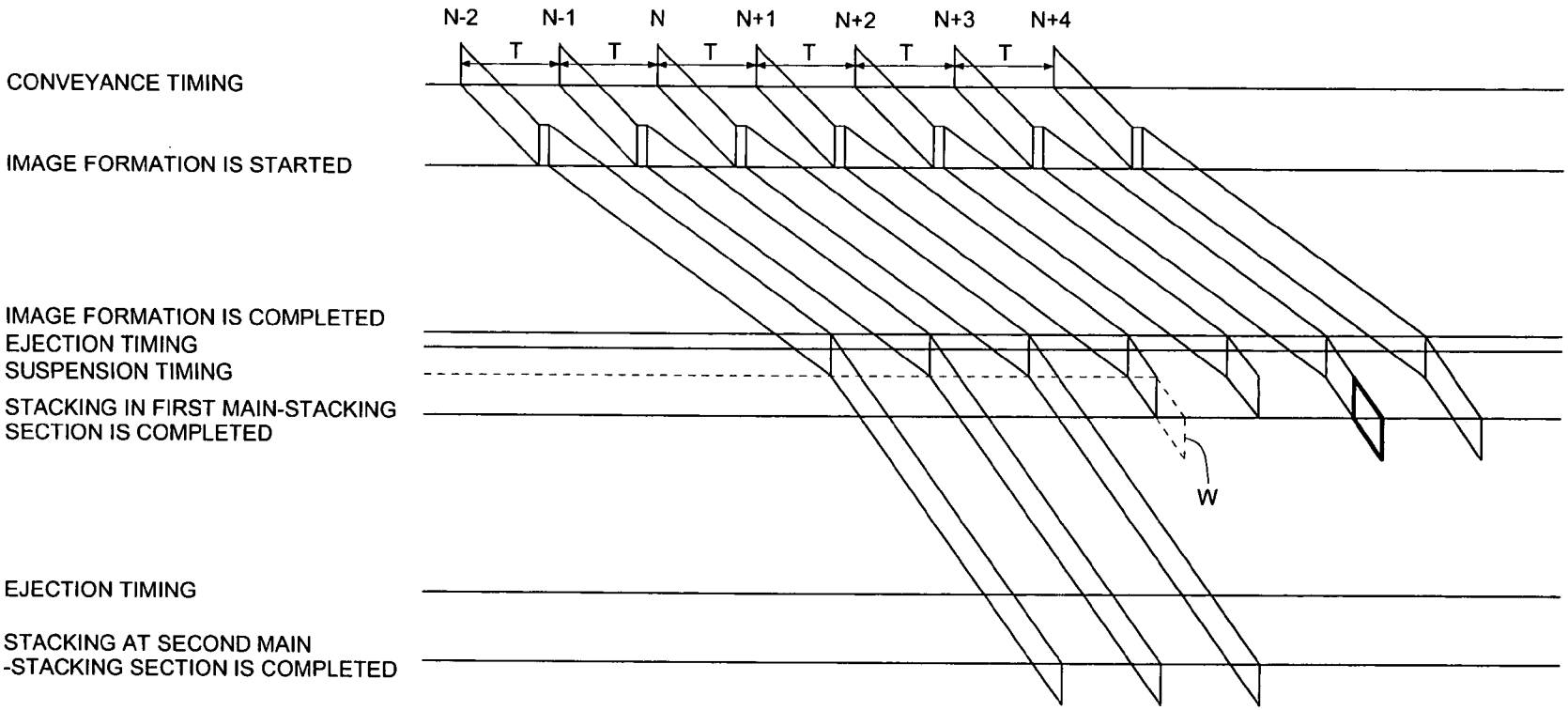
FIG. 12 is a timing chart representing the conveyance timing of the suspension method used in the image forming system given in FIG. 1.

The following describes the case where the destination is switched from the second main-stacking section 41B to the first main-stacking section 41A:

In this case as well, the interval timed for conveyance T is set at the minimum possible level in order to increase the speed. If the interval timed for conveyance T is smaller than the difference in conveyance time, the (N+1)th sheet of paper P is stacked on the first main-stacking section 41A before the N-th sheet of paper P is stacked on the second main-stacking section 41B (See the wavy line W in FIG. 12). Under this condition, the (N+1)th sheet of paper P with an image formed thereon will be stacked on the first main-stacking section 41A, if the N-th sheet of paper P is jammed in the second sheet conveyance path when the destination is switched. This will disturb the order of stacking when image formation is restarted subsequent to clearing of the jammed paper. To prevent this, a wait mode is used to cause the (N+1)th and subsequent sheets of paper P to wait.

The following describes the wait mode: The wait mode is an image forming method by which paper P is made to wait at any one of the sheet storing sections 21 and 22, common sheet conveyance path and first sheet conveyance path, to ensure that the (N+1)th and subsequent sheets of paper P will be stacked on the first main-stacking section 41A after the (N+1) th sheet of paper P has been stacked on the second main-stacking section 41B. If this wait mode is used, the (N+1)th sheet of paper P is stacked on the first main-stacking section 41A after the N-th sheet of paper P has been stacked on the second main-stacking section 41B, when the first sheet switching section 52A has been switched in such a way that the N-th sheet with an image formed thereon is fed by the second sheet conveyance path and the (N+1)th sheet of paper P with an image formed thereon is conveyed along the first sheet conveyance path. Accordingly, even if the N-th sheet of paper P has been jammed in the second sheet conveyance path, the (N+1)th sheet is not stacked on the first main-stacking section 41A. To put it another way, even if image formation is restarted after clearing of the jammed paper, a correct order of stacking can be ensured by controlling the subsequent order of image formation.

Figure 5:
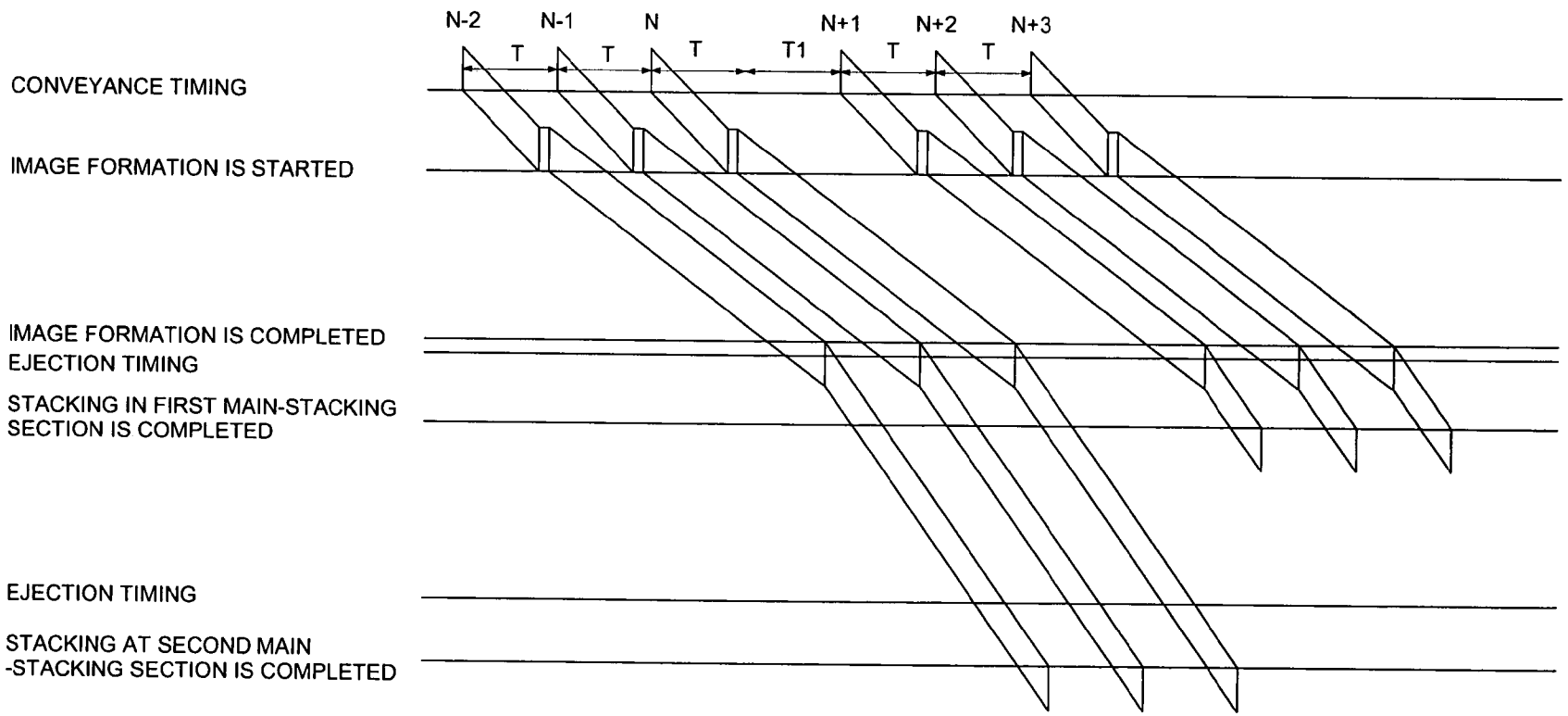
FIG. 5 is a timing chart representing the timing of conveyance according to the delay method used in the image forming system given in FIG. 1.

In the wait mode of the present embodiment, the interval timed for conveying the N-th sheet of paper P and (N+1)th and subsequent sheets of paper P is set greater than the difference in conveyance time, and the interval timed for conveyance subsequent to switching of the destination is delayed, whereby the (N+1)th sheet is made to wait until the N-th sheet is stacked on the second main-stacking section 41B. According to this delay method, as shown in the timing chart of FIG. 5, for example, the N-th sheet of paper P is conveyed from the sheet storing sections 21 and 22, and the sheet feed sections 23 and 24 are stopped for a predetermined time T1. Then the sheet feed sections 23 and 24 are restarted and the (N+1)th sheet of paper P is conveyed. In this case, since the predetermined time T1 is set greater than the difference in sheet conveyance time, the (N+1)th sheet of paper P is stacked on the first main-stacking section 41A after the N-th sheet of paper P has been stacked on the second main-stacking section 41B.

If this delay method is used, the interval between the N-th sheet of paper P and the (N+1)th sheet of paper P is set greater than the interval of the sheets of paper P (interval timed for conveyance T) when sheets of paper P area continuously fed to any one of the first main-stacking section 41A and automatic document feeder 42*b*, whereby the (N+1)th sheet of paper P can be stacked on the first main-stacking section 41A after the (N+1)th sheet of paper P has been stacked on the second main-stacking section 41B. This arrangement ensures thorough switching by the first sheet switching section 52A.

Figure 6:
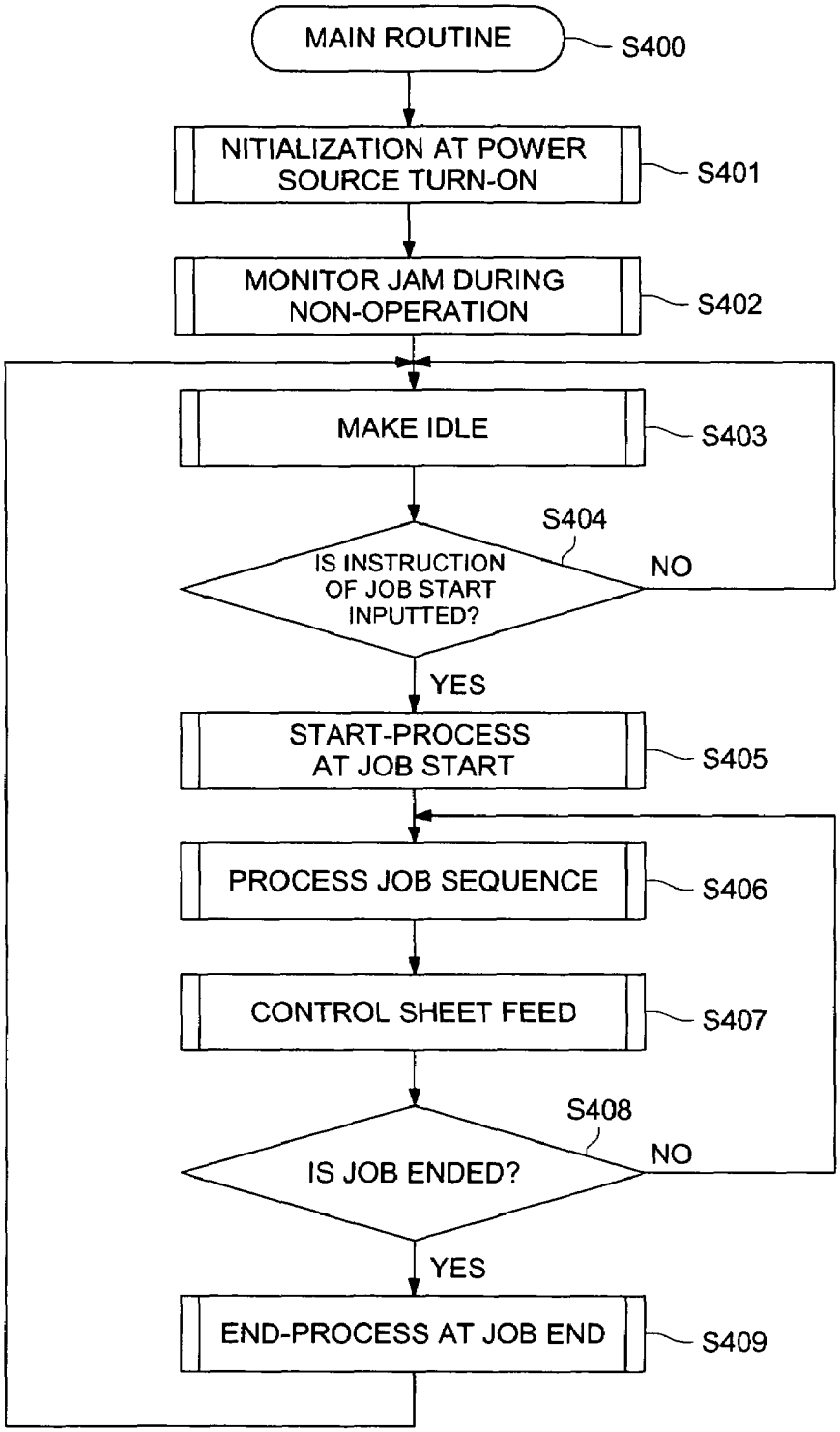
FIG. 6 is a flowchart on the side of the image forming system, showing the main routine as an example of the wait mode used in the image forming system given in FIG. 1.
Figure 7:
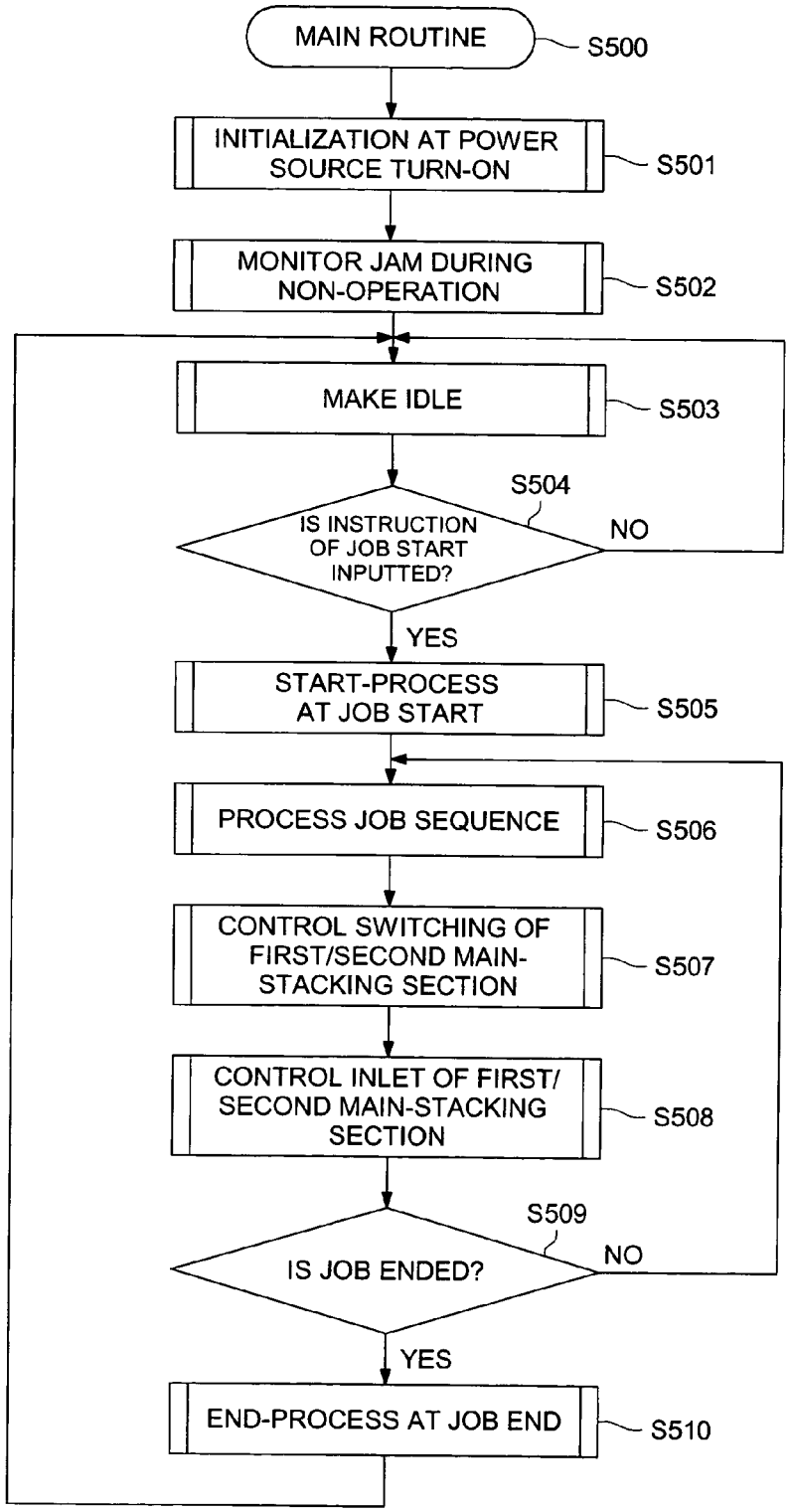
FIG. 7 is a flowchart on the side of the first and second stacking devices, showing the main routine as an example of the wait mode used in the image forming system given in FIG. 1.

The following describes the specific example of the wait mode control procedure based on the delay method with reference to the flowcharts of FIGS. 6 through 11. FIG. 6 is a flowchart on the side of the image forming apparatus 2, showing the main routine as an example of the wait mode used in the control device 35 of the image forming apparatus 2. FIG. 7 is a flowchart on the side of the first stacking device 40A and second stacking device 40B, showing the main routine as an example of the wait mode.

As shown in FIGS. 6 and 7, when power is supplied to the entire image forming system 1, the control device 35 starts the main routine (Steps S400 and S500), initialization is carried out at the time of power being turned on (Steps S401 and S501), jamming is monitored in the non-operation mode (Steps S402 and S502). Upon completion of jam monitoring in the non-operation mode, the control device 35 applies processing of idling so that the image forming apparatus 2, first stacking device 40A and second stacking device 40B are placed in an idle state (Steps S403 and S503).

In an idle state, the control device 35 determines whether the job start instruction has been inputted or not (Steps S404 and S504). If the instruction is not inputted, the control device 35 goes to the Steps S403 and S503. If the instruction is inputted, control goes to the Steps S405 and S505, and applies processing of starting at the time of job startup so that each of the image forming apparatus 2, first stacking device 40A and second stacking device 40B respond to the job start (Steps S405 and S505). Then based on an image data item in the job, the control device 35 applies processing of job sequence (Steps S406 and S506), and control goes to Steps S407 and S507).

The control device 35 controls sheet feed in Step S407 on the side of the image forming apparatus 2, and controls the first and second main stacking section switching in Step S507 on the side of the first stacking device 40A and second stacking device 40B. In Step S508, the control device 35 provides the first and second main stacking section inlet control in Step S508. In this case, sheet feed control, the first and second main stacking section switching control and first and second main stacking section inlet control are different according to the method employed.

When the delay system is employed, the control device 35 provides paper feed control, first and second main stacking section switching and first and second main stacking section inlet control according to the flowchart shown in FIGS. 8 through 11.

Figure 8:
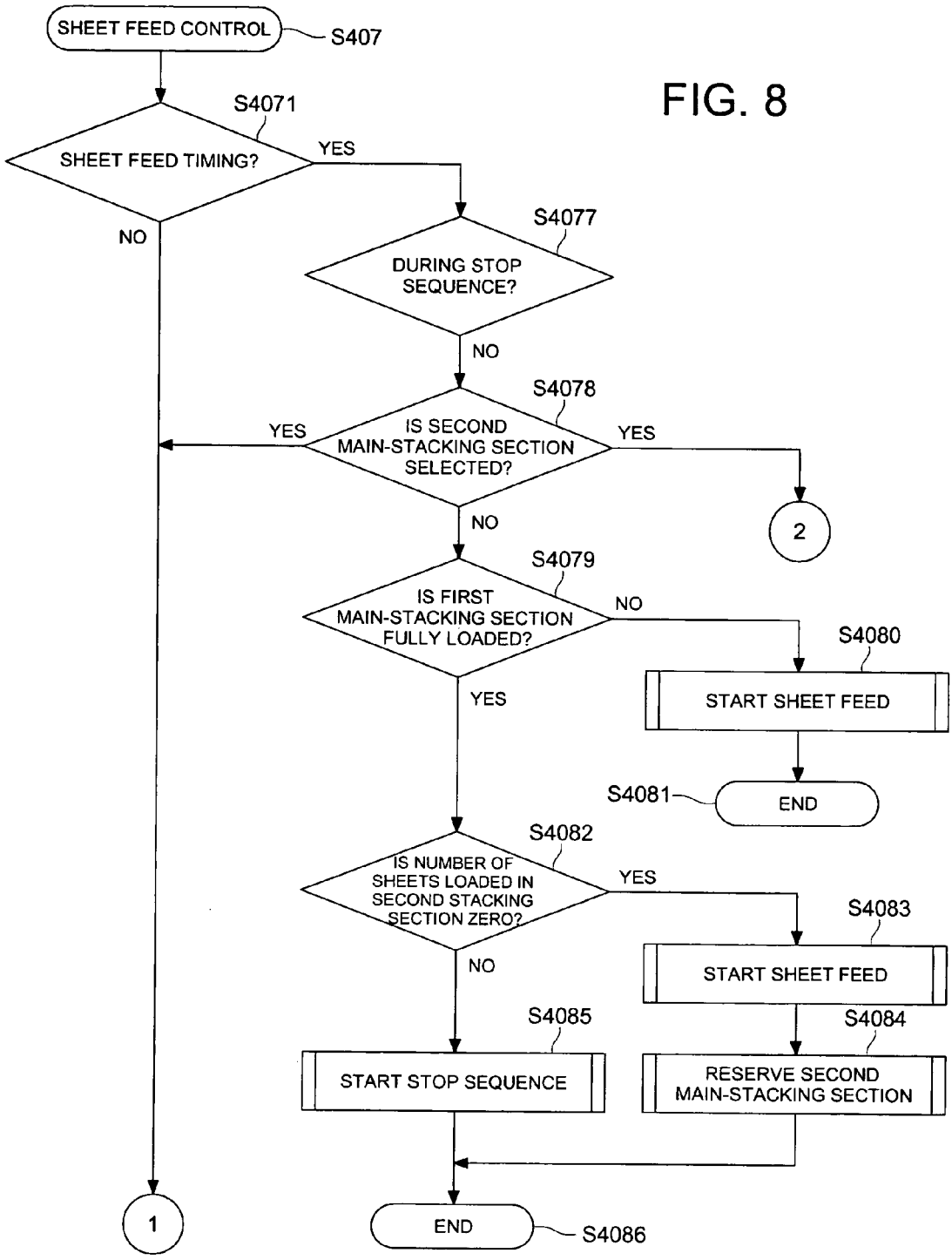
FIG. 8 is a flowchart representing the sheet of paper feed control of the main routine in FIG. 6, corresponding to the delay method.
Figure 9:
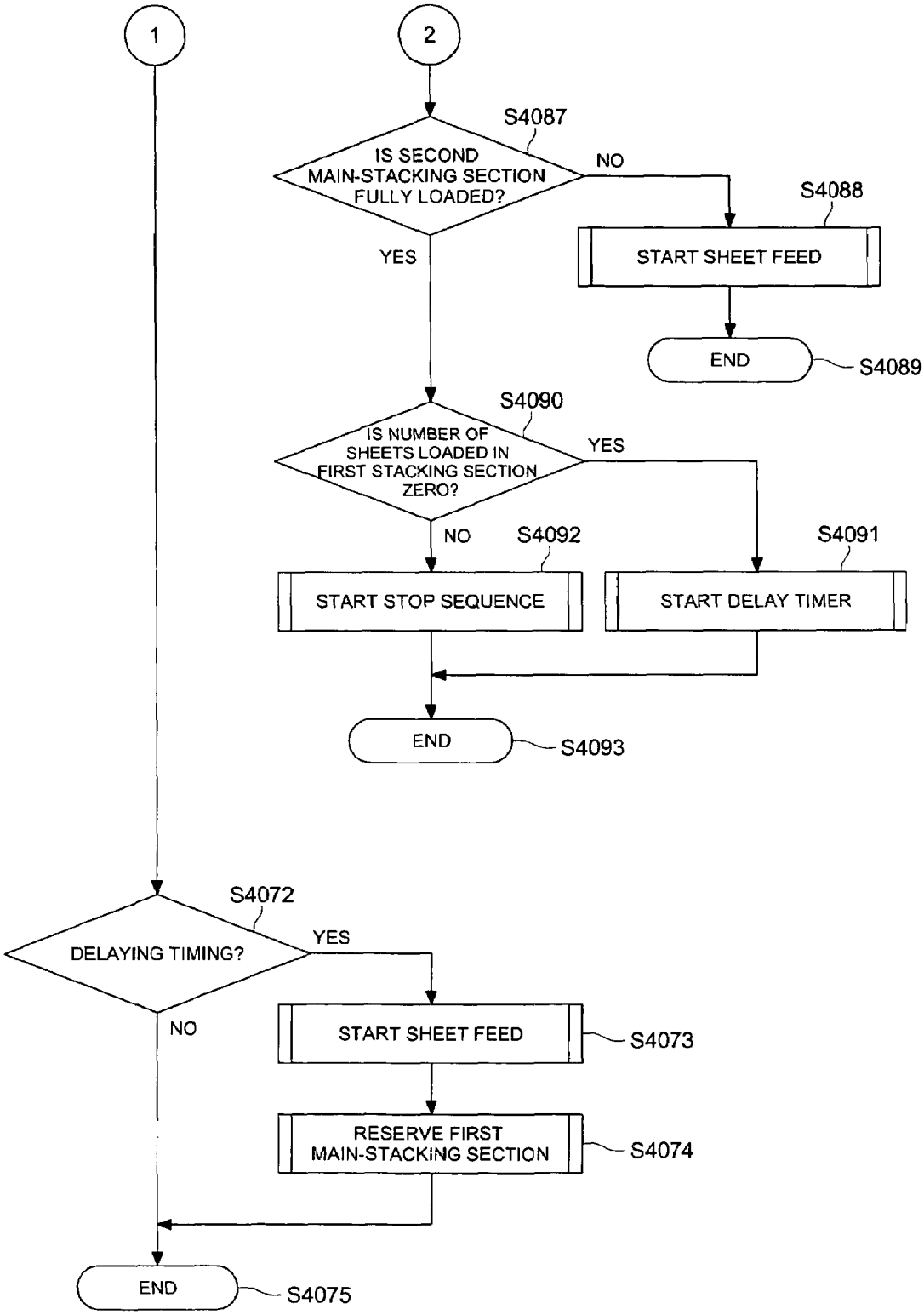
FIG. 9 is a flowchart representing the continuation of the sheet of paper feed control given in FIG. 8.

Referring to FIGS. 8 and 9, the following describes the sheet feed control based on the delay method. If sheet feed control is started in Step S407, the control device 35 checks if the timing of sheet feed has come or not (Steps S4071). If the timing of sheet feed has come, control goes to Step S4077. If not, control goes to Step S4072.

In Step S4072, a decision is made to see if the delay timing (a predetermined time period T1+interval timed for conveyance T) that comes later than the timing for sheet feed has come or not.

When control goes to Step S4073, the control device 35 starts sheet feed and goes to the Step S4074. A reservation is made to ensure that the fed paper P is stacked on the first main-stacking section 41A, and the control goes to the Step S4075. In Step S4075, the control device 35 terminates sheet feed control.

When timing for sheet feed has been determined in Step S4071 and control has come to Step S4077, the control device 35 checks if the current status is a stop sequence or not. If so, control goes to Step S4072. If not, it goes to Step S4078.

In Step S4078, the control device 35 checks whether or not the second main-stacking section 41B has been selected as the current destination. If the second main-stacking section 41B has been selected, the control goes to Step S4087. If not, the control goes to Step S4079.

In Step S4079, the control device 35 checks whether or not the first main-stacking section 41A is fully loaded. If so, the control goes to Step S4079. If not, it goes to Step S4080.

In Step S4080, the control device 35 starts sheet feed and then goes to Step S4081 to terminate the sheet feed control.

In Step S4082, the control device 35 checks if the number of sheets stacked on the second main-stacking section 41B is zero or not. If so, it goes to Step S4083. If not, it goes to Step S4085.

After going to the Step S4083, the control device 35 starts sheet feed and then goes to Step S4084 to make a reservation so that the fed paper P will be stacked on the second main-stacking section 41B. Then the control goes to Step S4086 to terminate sheet feed control.

After going to Step S4085, the control device 35 starts the stop sequence and then proceeds to Step S4086 to terminate sheet feed.

If a decision has been made in Step S4078 that the second main-stacking section 41B is selected and the control has proceeded to the Step S4087, the control device 35 checks if the second main-stacking section 41B is fully loaded or not. If so, the control proceeds to the Step S4090. If not, it goes to the Step S4088.

If the control proceeds to the Step S4088, the control device 35 starts sheet feed and then goes to the Step S4089 to terminate the sheet feed control.

In Step S4090, the control device 35 checks if the number of sheets stacked on the first main-stacking section 41A is zero or not. If so, it goes to Step S4091. If not, it goes to Step S4092.

After it has proceeded to the Step S4091, the control device 35 starts the delay timer (not illustrated) and proceeds to the Step S4093 to terminate the sheet feed control.

After it has proceeded to the Step S4092, the control device 35 starts the starts the stop sequence and then proceeds to Step S4093 to terminate sheet feed.

Figure 10:
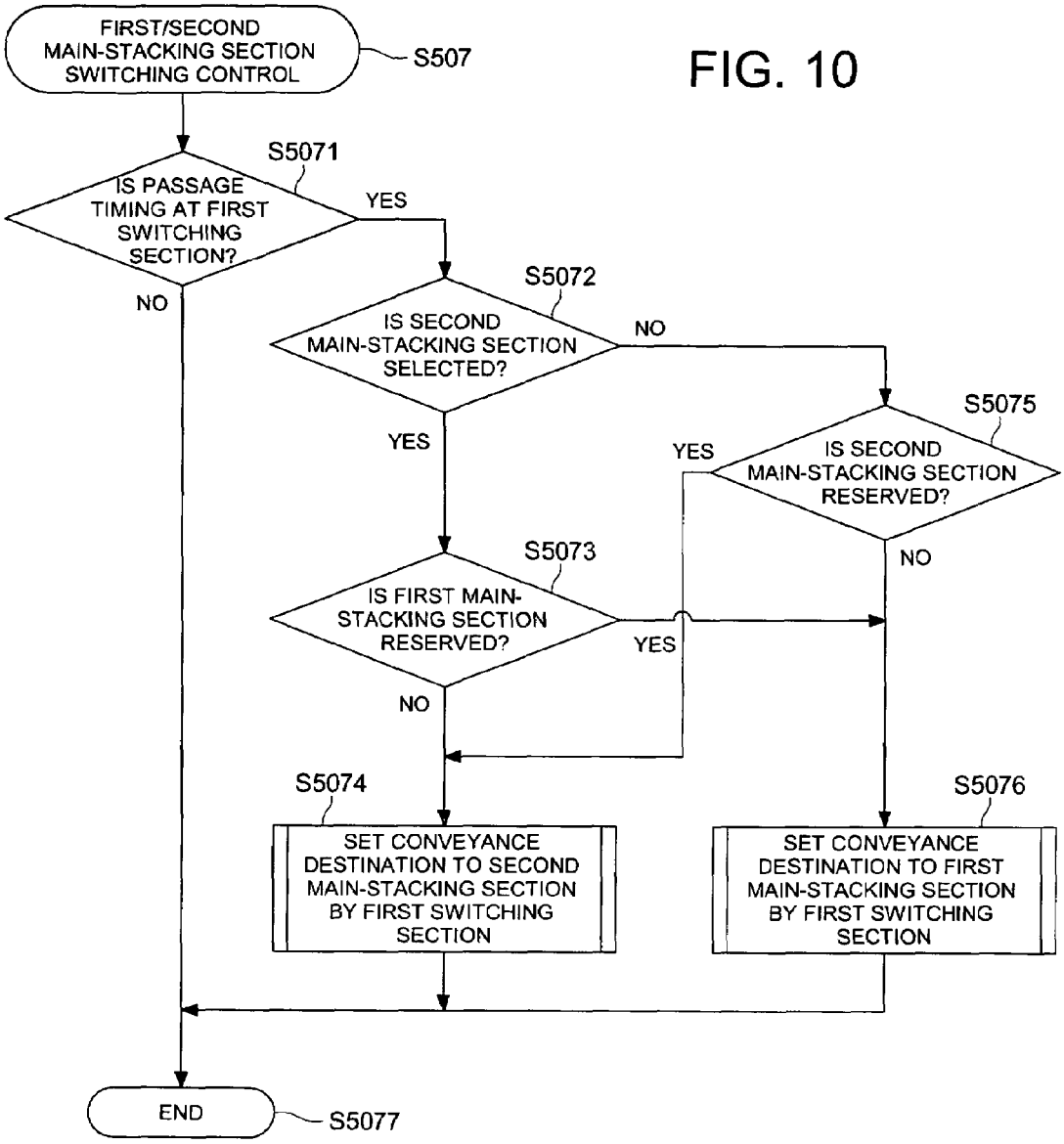
FIG. 10 is a flowchart representing the control of switching between the first and second stacking sections of the main routine in FIG. 7, corresponding to the delay method.

Referring to FIG. 10, the following describes the first and second main stacking section switching control. In Step S507, when the first and second main stacking section switching control has started, the control device 35 checks if this is the time for the paper P to pass through first sheet switching section 52A (Step S5071). If so, the control proceeds to the Step S5072. If not, it goes to the Step S5077.

In Step S5072, the control device 35 checks whether or not the second main-stacking section 41B has been selected as the current destination. If the second main-stacking section 41B has been selected, the control goes to Step S5073. If not, the control goes to Step S5075.

In Step S5073, the control device 35 checks whether or not the first main-stacking section 41A has been reserved as a destination for the paper P passing through the first sheet switching section 52A. If so, the control goes to the Step S5076. If not, it goes to the Step S5074.

In Step S5075, the control device 35 checks whether or not the second main-stacking section 41B is reserved as the destination of the paper P having passes through the first sheet switching section 52A. If it is reserved, the control goes to Step S5074. If not, the control goes to Step S5076.

In the Step S5074, the control device 35 sets the first sheet switching section 52A so that the second main-stacking section 41B will be the destination, and proceeds to the Step S5077.

In the Step S5076, the control device 35 sets the first sheet switching section 52A so that the first main-stacking section 41A will be the destination, and proceeds to the Step S5077.

In the Step S5077, the control device 35 terminates the first and second main stacking section switching control.

Figure 11:
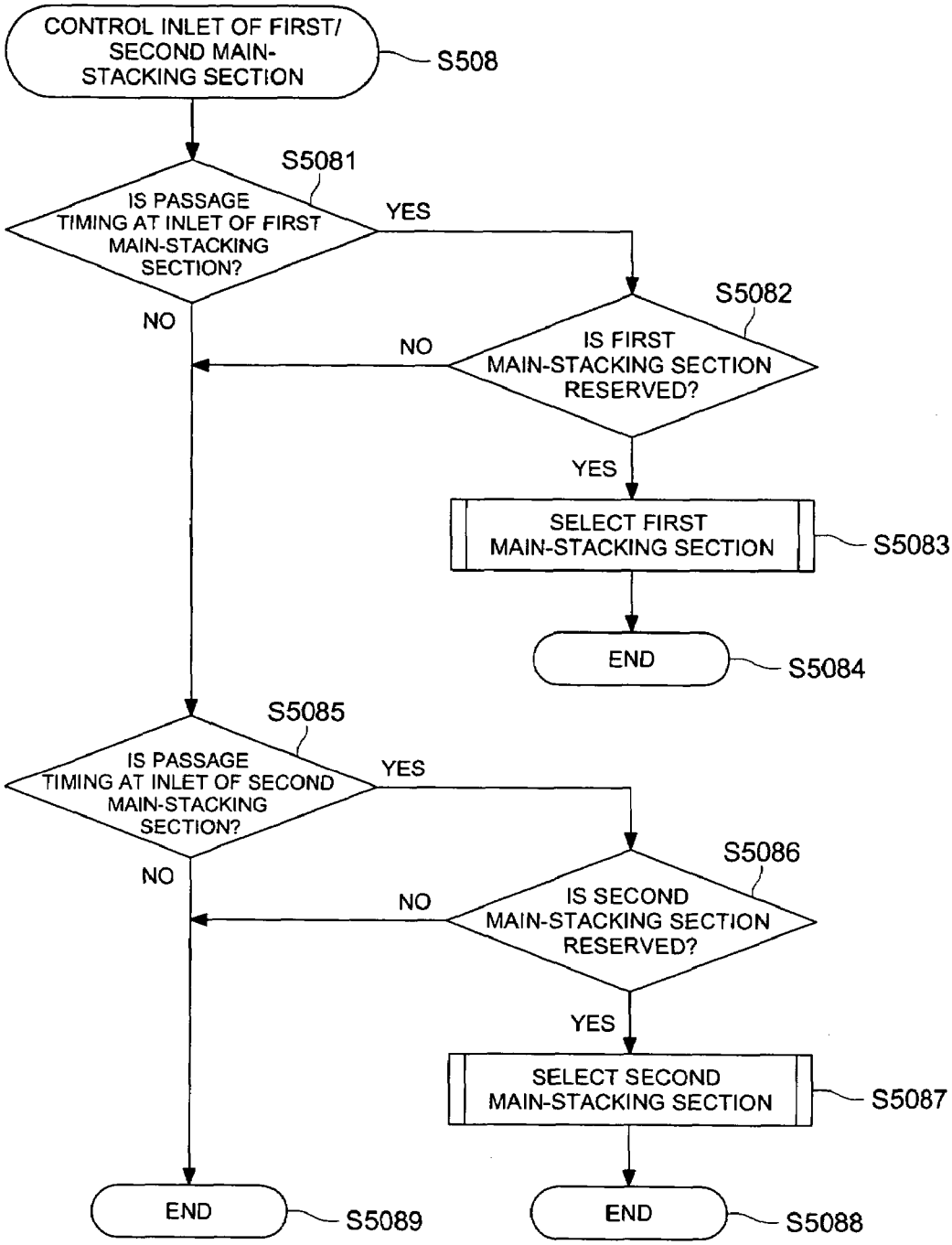
FIG. 11 is a flowchart representing the control of inlets of the first and second stacking sections of the main routine in FIG. 7, corresponding to the delay method.

Referring to FIG. 11, the following describes the first and second main stacking section inlet control. When the first and second main stacking section inlet control is started in the Step S508, the control device 35 checks whether or not this is the time for paper P to pass through the inlet of the first sheet conveyance section 51A (Steps S5081). If so, the control proceeds to the Step S5082. If not, it goes to the Step S5085.

In the Step S5082, the control device 35 checks whether or not the first main-stacking section 41A has been reserved as a destination for the paper P passing through the first main-stacking section 41A. If so, the control goes to the Step S5083. If not, it goes to the Step S5085.

In the Step S5083, the control device 35 selects the first main-stacking section 41A and proceeds to the Step S5084 to terminate the first and second main stacking section inlet control.

In the Step S5085, the control device 35 checks whether or not this is the time for paper P to pass through the inlet of the second main-stacking section 41B. If so, the control proceeds to the Step S5086. If not, it goes to the Step S5089.

In the Step S5086, the control device 35 checks whether or not the second main-stacking section 41B has been reserved as a destination for the paper P passing through the second main-stacking section 41B. If so, the control goes to the Step S5087. If not, it goes to the Step S5089.

In the Step S5087, the control device 35 selects the second main-stacking section 41B and proceeds to the Step S5088 to terminate the first and second main-stacking section inlet control.

In the Step S5089, the control device 35 terminates the first and second main-stacking section inlet control.

As described above, the image forming system 1 of the present embodiment uses the wait mode wherein the (N+1)th and subsequent sheets are made to wait if a paper jam has occurred. This arrangement prevents the order of stacking from being disturbed even if the interval timed for conveyance is made smaller than the difference in conveyance time. Thus, when clearing the jammed paper, this arrangement allows the operator to avoid disturbance of the order of stacking, merely by removing the N-th sheet having been jammed along the second conveyance path without removing the sheets stacked on the first conveyance destination or checking the order of stacking against the original.

Further, when the delay method is used in the wait mode, it is possible to prevent the order of stacking from being disturbed without using the first suspension mechanism 43A. This arrangement eliminates the need of using the first suspension mechanism 43A.

The present invention can be embodied in a great number of improvements and engineering modifications without departing from the technological spirit and scope of the invention claimed.

For example, according to the aforementioned present embodiment, the delay method is used in the wait mode. It is also possible to use the suspension method in the wait mode in such a way that the (N+1)th and subsequent sheets of paper P subsequent to image formation by the first suspension mechanism 43A are suspended, and are made to wait until the (N+1)th sheet of paper P is stacked on the second main-stacking section 41B. In the suspension method, as shown in the timing chart of FIG. 12, (N+1)th and (N+2)th sheets of paper P are suspended one on top of the other, until the (N+3)th sheet of paper P is conveyed to the first suspension mechanism 43A. When these three sheets of paper P are located at the first suspension mechanism 43A, the first suspension mechanism 43A puts the suspended sheets of paper P on top of each other, and conveys them to the first main-stacking section 41A.

The following describes the case where the suspension method is used in the wait mode: The main routing of the wait mode shown in FIGS. 6 and 7 is also applicable when the suspension method is used in the wait mode.

Figure 13:
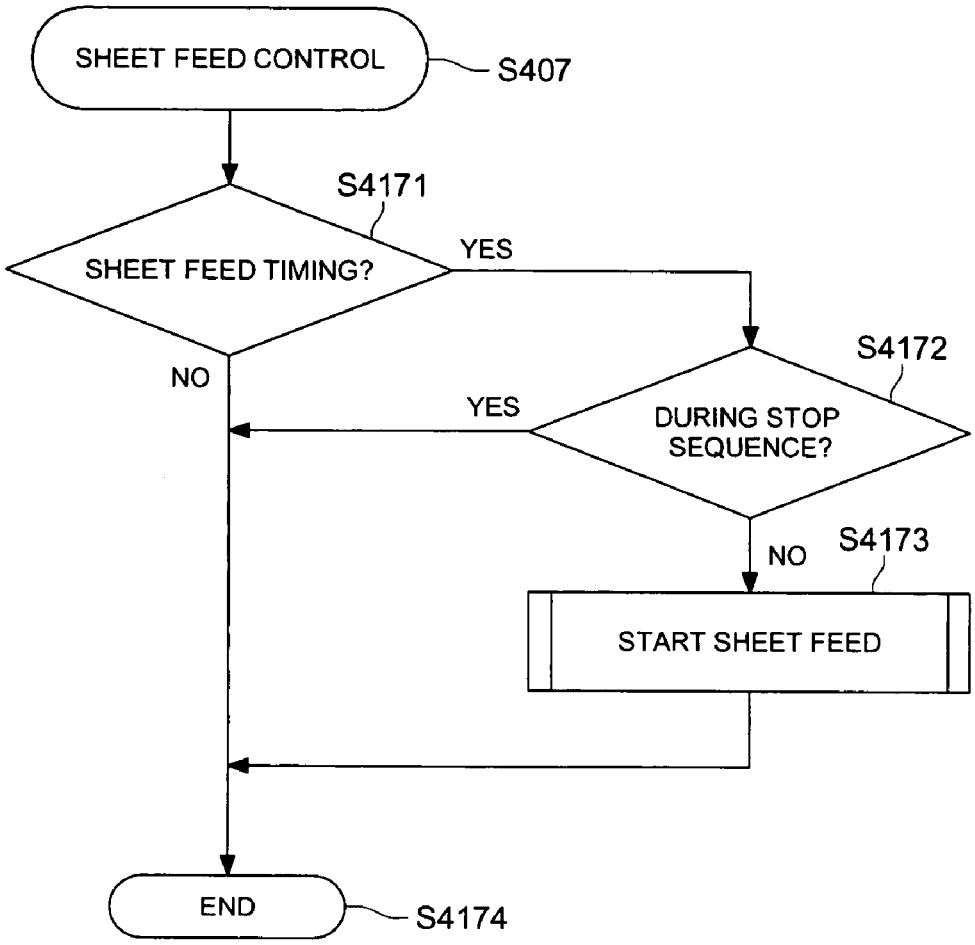
FIG. 13 is a flowchart representing the sheet feed control of the main routine in FIG. 6, corresponding to the suspension method.

In the first place, the following describes the sheet feed control in the suspension method with reference to FIG. 13. When sheet feed is started in the Step S407, the control device 35 checks if this is the time to feed the sheet or not. (Step S4171). If so, the control proceeds to the Step S4172. If not, it goes to the Step S4173. To put it another way, a configuration is arranged in such a way that paper P is fed at regular intervals so long as the system stop sequence is not started.

In the Step S4172, control device 35 checks whether or not the system is in the stop sequence. If so, the control proceeds to the Step S4174. If not, it goes to the Step S4173.

In the Step S4173, the control device 35 starts sheet fed and proceeds to the Step S4174.

In the Step S4174, the control device 35 terminates sheet feed control.

Figure 14:
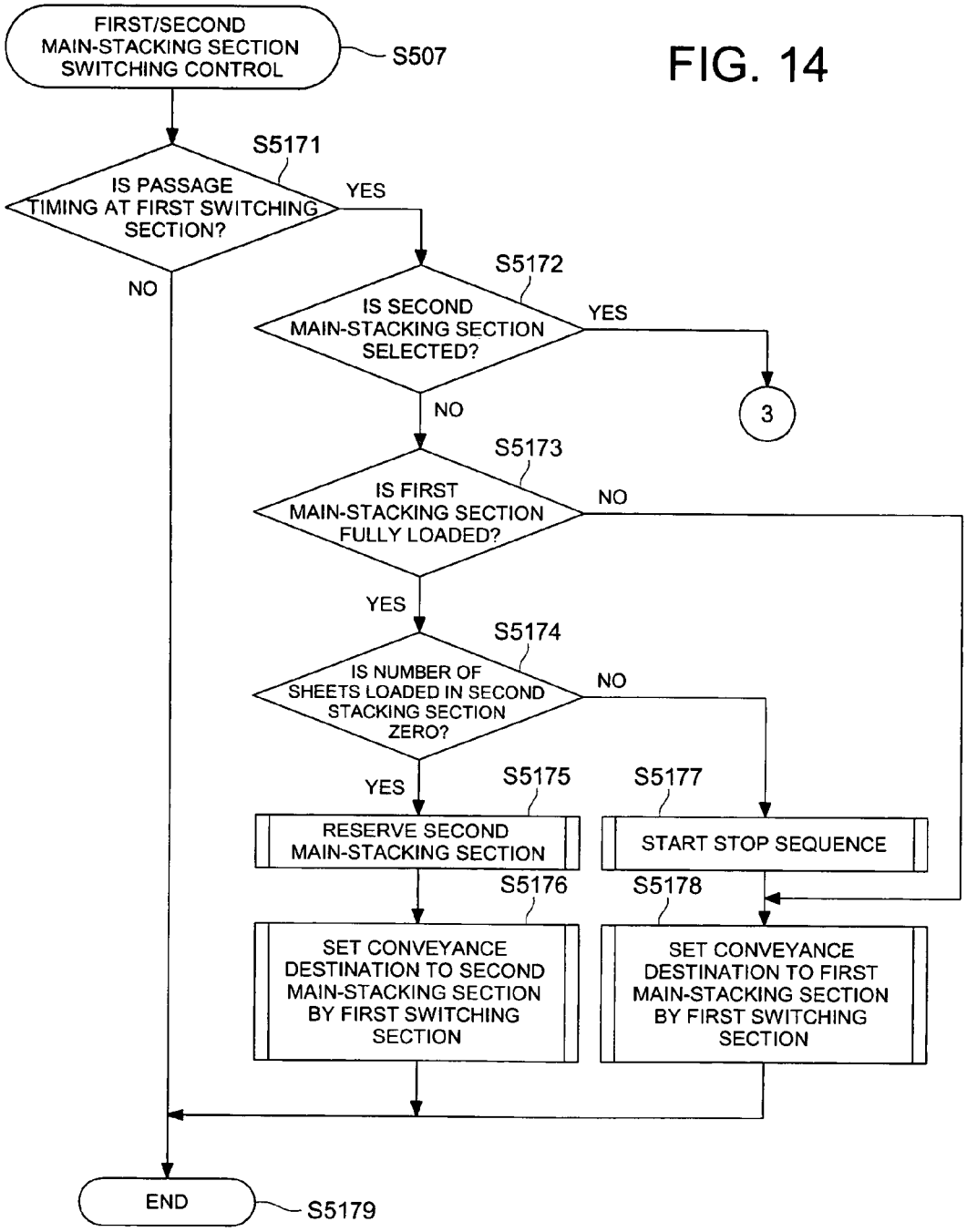
FIG. 14 is a flowchart representing the control of switching between the first and second main stacking sections of the main routine in FIG. 7, corresponding to the suspension method.
Figure 15:
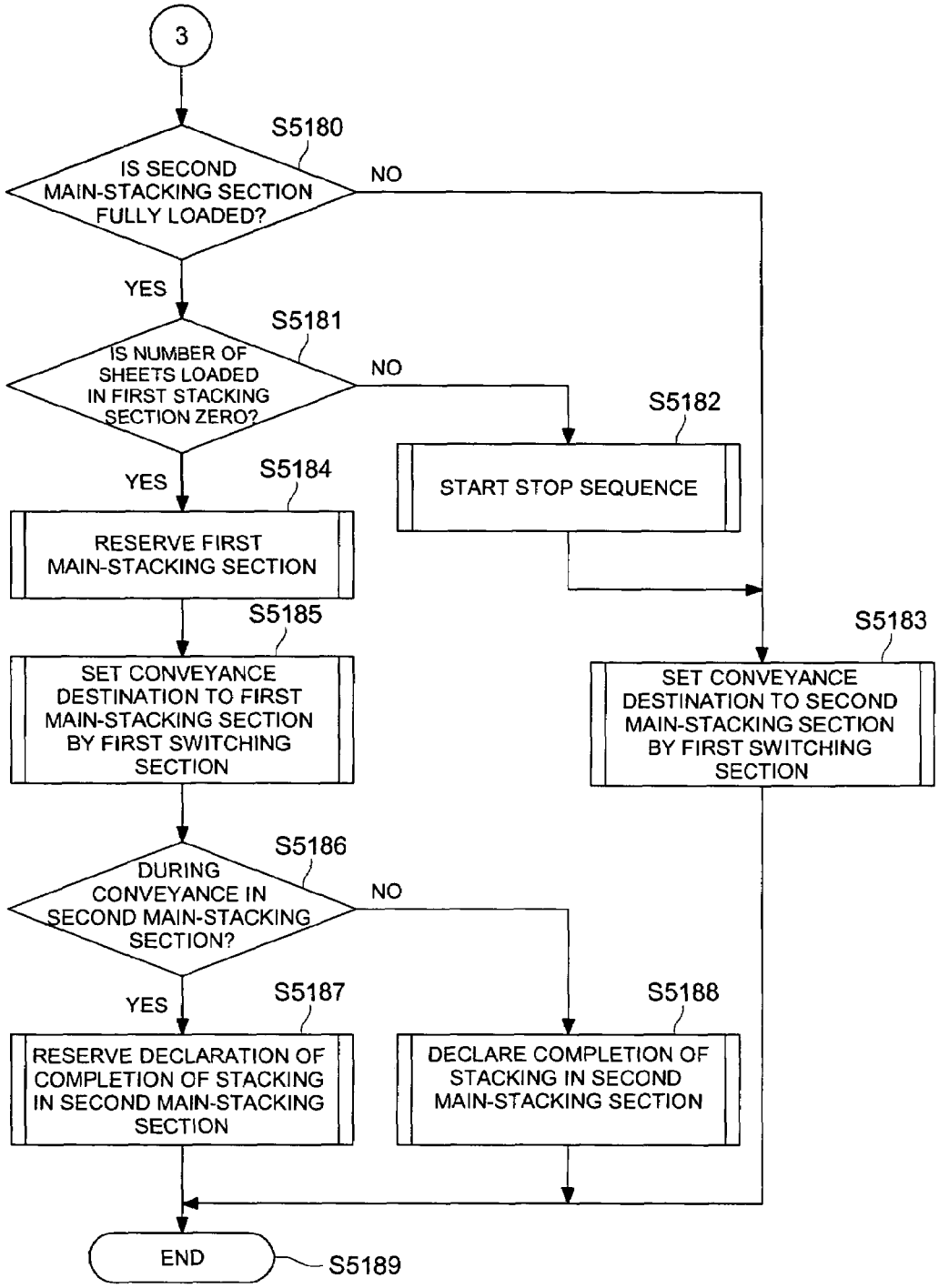
FIG. 15 is a flowchart representing the continuation of the control of switching between the first and second main stacking sections given in FIG. 14.

Referring to FIGS. 14 and 15, the following describes the first and second main-stacking section switching control.

In the first and second main-stacking section switching control, if the destination of the paper P going to pass through the first sheet switching section 52A is fully loaded and the other destination is empty, the destination is switched from this paper P and the sheets of paper P will be fed. To put it in greater details, as shown in FIGS. 14 and 15, when the first and second main-stacking section switching control has started in the Step S507, the control device 35 checks whether or not this is the time for paper P to pass through the first sheet switching section 52A (Step S5171). If so, the control proceeds to the Step S5172. If not, it goes to the Step S5179.

In Step S5172, the control device 35 checks whether or not the second main-stacking section 41B has been selected as the current destination. If the second main-stacking section 41B has been selected, the control goes to Step S5178. If not, the control goes to Step S5073.

In the Step S5173, the control device 35 checks if the first main-stacking section 41A is fully loaded or not. If so, the control proceeds to the Step S5174. If not, it goes to the Step S5178.

In Step S5174, the control device 35 checks if the number of sheets stacked on the second main-stacking section 41B is zero or not. If so, it goes to Step S5175. If not, it goes to Step S5177.

In the Step S5175, the control device 35 reserves the second main-stacking section 41B as the destination and proceeds to the Step S5176. The control device 35 sets the first sheet switching section 52A in such a way that the second main-stacking section 41B will be the destination and proceeds to the Step S5179.

In the Step S5177, the control device 35 starts the stop sequence and proceeds to the Step S5178.

In the Step S5178, the control device 35 sets the first sheet switching section 52A so that the first main-stacking section 41A will be the destination, and proceeds to the Step S5179.

In the Step S5179, the control device 35 terminates the first and second main-stacking section switching control.

When a decision is made in the Step S5172 that the second main-stacking section 41B has been selected, and the control has proceeded to the Step S5180, the control device 35 checks whether or not the second main-stacking section 41B is fully loaded. If it is fully loaded, the control proceeds to the Step S5181. If not, it goes to the Step S5183.

In Step S5181 the control device 35 checks if the number of sheets stacked on the first main-stacking section 41A is zero or not. If so, it goes to Step S5184. If not, it goes to Step S5182.

In the Step S5182, the control device 35 starts the stop sequence and proceeds to the Step S5183.

In the Step S5183, the control device 35 sets the first sheet switching section 52A so that the second main-stacking section 41B will be the destination, and proceeds to the Step S5189.

When a decision is made in Step S5181 that the number of sheets stacked on the first main-stacking section 41A is zero, and the control has proceeded to the Step S5184, the control device 35 reserves the first main-stacking section 41A as the destination and proceeds to the Step S5185.

In the Step S5185, the control device 35 sets the first sheet switching section 52A in such a way that the first main-stacking section 41A will be the destination and proceeds to the Step S5186.

In the Step S5186, suspension of the paper P is necessary only when the second main-stacking section 41B located farther is switched over to the first main-stacking section 41A located closer. Accordingly, when the destination of the paper P passing through the first sheet switching section 52A is the second main-stacking section 41B, and the preceding paper P is present in the second sheet conveyance path, the control device 35 proceeds to the Step S5187. If it is not present, the control device 35 goes to the Step S5188.

In the Step S5187, the control device 35 makes a reservation declare completion of stacking if the paper P being conveyed has been stacked on the second main-stacking section 41B, and proceeds to the Step S5189.

In the Step S5188, the control device 35 declares completion of stacking since the second main-stacking section 41B has been loaded, and proceeds to the Step S5189.

In the Step S5189, the control device 35 terminates the first and second main-stacking section switching control.

Figure 16:
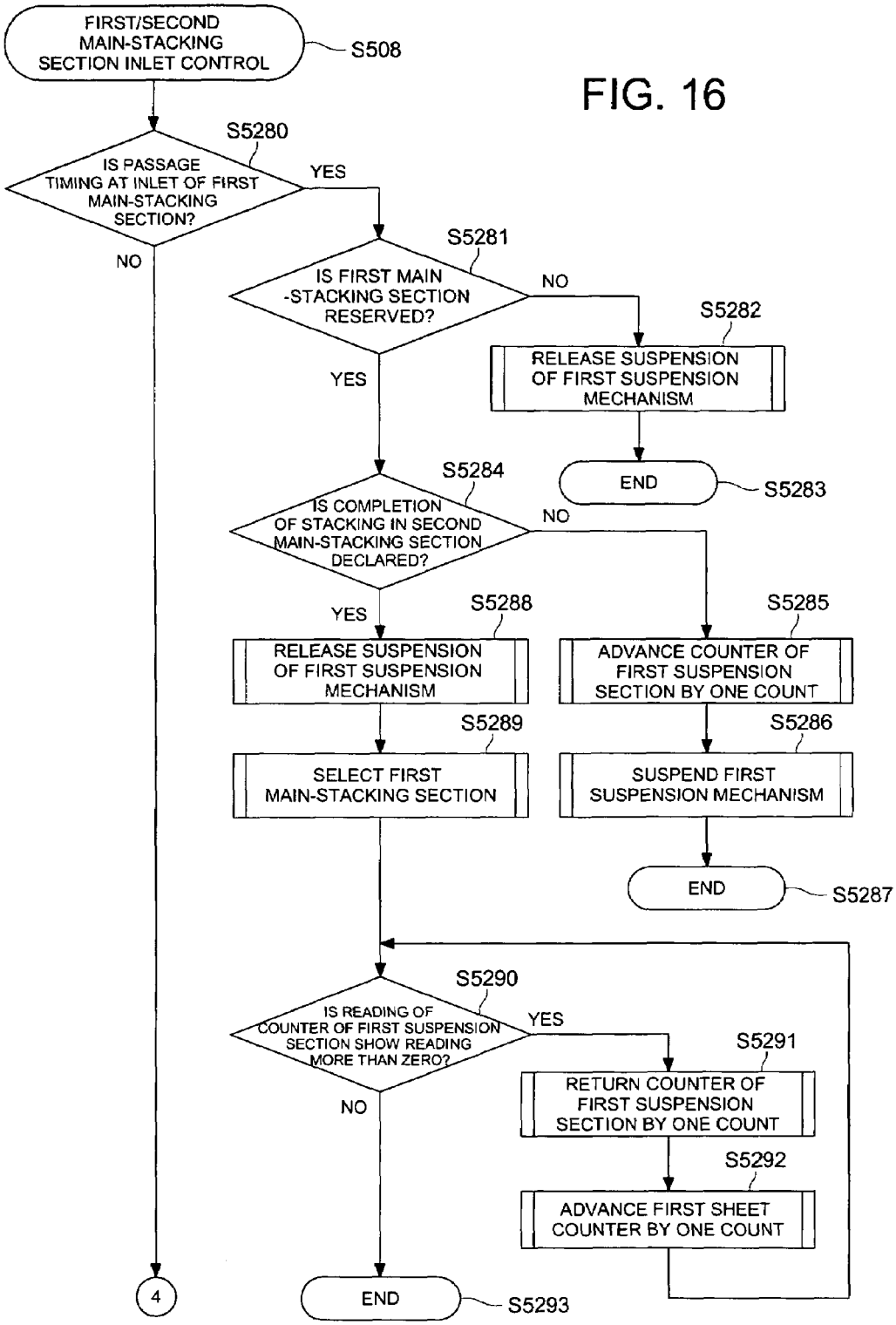
FIG. 16 is a flowchart representing the control of inlets of the first and second main stacking sections of the main routine in FIG. 7, corresponding to the suspension method.

Referring to FIGS. 16 and 17, the following describes the first and second main-stacking section inlet control in the suspension method. In the first and second main stacking section inlet control, when paper P has reached the first main-stacking section 41A, evaluation is made to determine whether or not the paper P is reserved for first main stacking, and to determine whether or not there is any paper P preceding this paper P in the second sheet conveyance path, by whether or not there is a declaration of completion for the second main stacking section, whereby the operating condition of the first suspension mechanism 43A is determined. To put it in greater details, as shown in FIGS. 16 and 17, if first and second main stacking section inlet control has started in the Step S508, the control device 35 checks whether or not this is the time for the paper P to pass through the inlet of the first main-stacking section 41A (Step S5280). If so, the control proceeds to the Step S5281. If not, it goes to Step S5294 in FIG. 17.

In the Step S5281, the control device 35 checks whether or not the first main-stacking section 41A has been reserved as a destination for the paper P passing through the inlet of the first main-stacking section 41A. If so, the control goes to the Step S5284. If not, it goes to the Step S5282.

In the Step S5282, the control device 35 releases suspension by the first suspension mechanism 43A so that the paper P will enter the first main-stacking section 41A, and proceeds to the Step S5283 to terminate the first and second main stacking section inlet control.

In the Step S5281, when it is determined that reservation has already been made and the control has proceeded to Step S5284, the control device 35 checks whether or not a declaration has been made of completion of the stacking on the second main-stacking section 41B. If so, the control goes to the Step S5288. If not, it goes to the Step S5285.

In the Step S5285, the control device 35 causes a first suspension counter (not illustrated) incorporated in the first suspension mechanism 43A, to be incremented by one, and proceeds to the Step S5286. In this case, the increment of the counter differs according to the number of sheets suspended. For example, if one sheet of paper P is suspended in the first suspension mechanism 43A, the count is "1". When three sheets of paper P are suspended in the first suspension mechanism 43A, the count is "3".

In the Step S5286, the suspension function of the first suspension mechanism 43A is applied to ensure that paper P will not enter the first main-stacking section 41A where paper is suspended. Then the control proceeds to the Step S5287 to terminate first and second main stacking section inlet control.

If a decision is in Step S5284 that a declaration has been made of completion of the stacking and the control goes to the Step S5288, the control device 35 releases suspension by the first suspension mechanism 43A so that the paper P will enter the first main-stacking section 41A, and proceeds to the Step S5289. In the Step S5289, the control device 35 selects the first main-stacking section 41A as the destination and proceeds to the Step S5290.

In the Step S5290, the control device 35 checks whether or not the first suspension counter indicates a value equal to or greater than zero. If it indicates a value equal to or greater than zero, the control proceeds to the Step S5291. If not, it goes to the Step S5293.

In the Step S5291, the control device 35 allows the first suspension counter to be decremented at a stretch by the number of sheets of paper P suspended in one operation and proceeds to the Step S5292. The control device 35 causes the first sheet counter 55A to be incremented by the count decremented in Step S5292 and proceeds to the Step S5290. For example, when three sheets of paper P have been suspended by one operation, the first suspension counter is decremented by "3" at a stretch, and the first sheet counter 55A is incremented by "3" at a stretch.

In the Step S5293, the control device 35 terminates the first and second main stacking section inlet control.

In the Step S5281, if the control device 35 has proceeded to the Step S5294 based on the decision that inlet timing has not yet come, the control device 35,checks whether or not this is the time for paper P to pass through the inlet of the second main-stacking section 41B. If so, it proceeds to the Step S5295. If not, it goes to the Step S5301.

In the Step S5295, the control device 35 checks whether or not the second main-stacking section 41B has been reserved as the destination of the paper P passing through the inlet of the second main-stacking section 41B. If so, it proceeds to the Step S5296. If not, it goes to the Step S5297.

In the Step S5296, the control device 35 selects the second main-stacking section 41B as the destination and proceeds to the Step S5297.

In the Step S5297, the control device 35 checks whether or not completion of stacking on the second main-stacking section reserved has been reserved for the preceding paper P. If so, it goes to Step S5298. If not, it goes to Step S5300.

In the Step S5298, the control device 35 checks whether or not the paper P passing through the inlet is the final sheet of paper to be loaded finally on the second main-stacking section 41B. If so, it goes to Step S5299. If not, it goes to Step S5300.

In the Step S5299, the control device 35 declares completion of stacking and proceeds to the Step S5300.

In the Step S5300, the control device 35 stops the second suspension mechanism 43B so that the paper P will enter the second main-stacking section 41B, and proceeds to the Step S5301.

In the Step S5301, the control device 35 terminates first and second main stacking section inlet control.

Upon completion of sheet feed control and first and second main stacking section inlet control, as shown in FIGS. 6 and 7, the control device 35 proceeds to the Steps S408 and S509, and checks general job end to determine whether or not the entire job sequence for the preset number of sheets has completed. If the preset number is not reached, the control proceeds to the Steps S406 and S506. If the preset number has been reached, the control proceeds to the Steps S409 and S510. It goes to Steps S403 and S503 after processing of termination at the job end.

As described above, when the suspension method is used in the wait mode, the first suspension mechanism 43A suspends the paper P, whereby the (N+1)th sheet is stacked on the first main-stacking section 41A after the N-th sheet of paper P has been stacked on the second main-stacking section 41B. This arrangement prevents the (N+1)th and subsequent sheets of paper P from being stacked on the first main-stacking section 41A before (N+1)th sheet, even if an image is recorded on the (N+1)th and subsequent sheets of paper P.

In the aforementioned suspension method, the first suspension mechanism 43A stops conveyance of the paper P, whereby paper P is suspended. Without being restricted to this configuration, it is also possible to arrange such a configuration that the paper P is suspended by decreasing the speed of conveying the (N+1)th sheet of paper P.

Embodiment 2

The following describes the image forming method as a second embodiment of the present invention. The image forming method according to the first embodiment has been described with reference to the wait method for allowing the (N+1)th and subsequent sheets of paper P to wait. The second image forming method will be described with reference to the sequence changing method for changing the sequence of image formation after a paper jam has occurred in the switching of conveyance. The image forming system 1 used in the explanation of the first embodiment will also be used in the description of the second embodiment.

Referring to FIGS. 18 through 23, the following describes the sequence changing method.

To change the sequence of image formation, various kinds of information are stored in the memory 38. For example, the memory 38 stores: information on the first stacking device 40A (the number of sheets C1A loadable on the first main-stacking section 41A, the count C1B of the first sheet counter 55A, the number of sheets C1M loadable on the first stacking device 40A at the start of job, etc.); information on the second stacking device 40B, the number of sheets C2A loadable on the second main-stacking section 41A, the count C2B of the second sheet counter 55B, the number of sheets C2M loadable on the second stacking device 40B at the start of job, etc.); and information on image data (image pointer IP of each image data item contained in one job, the first offset value P1F when the second main-stacking section 41B is switched over to the first main-stacking section 41A, the second offset value P2F of the image pointer IP when the destination is switched from the first main-stacking section 41A to the second main-stacking section 41B). In this case, "job" can be defined as the formation of an image carried out on at least one sheet of paper P by one image formation instruction. To put it another way, one job includes at least one image data item for one sheet of paper P and an image pointer is set for each image data, based on the sequence of image formation.

Figure 18:
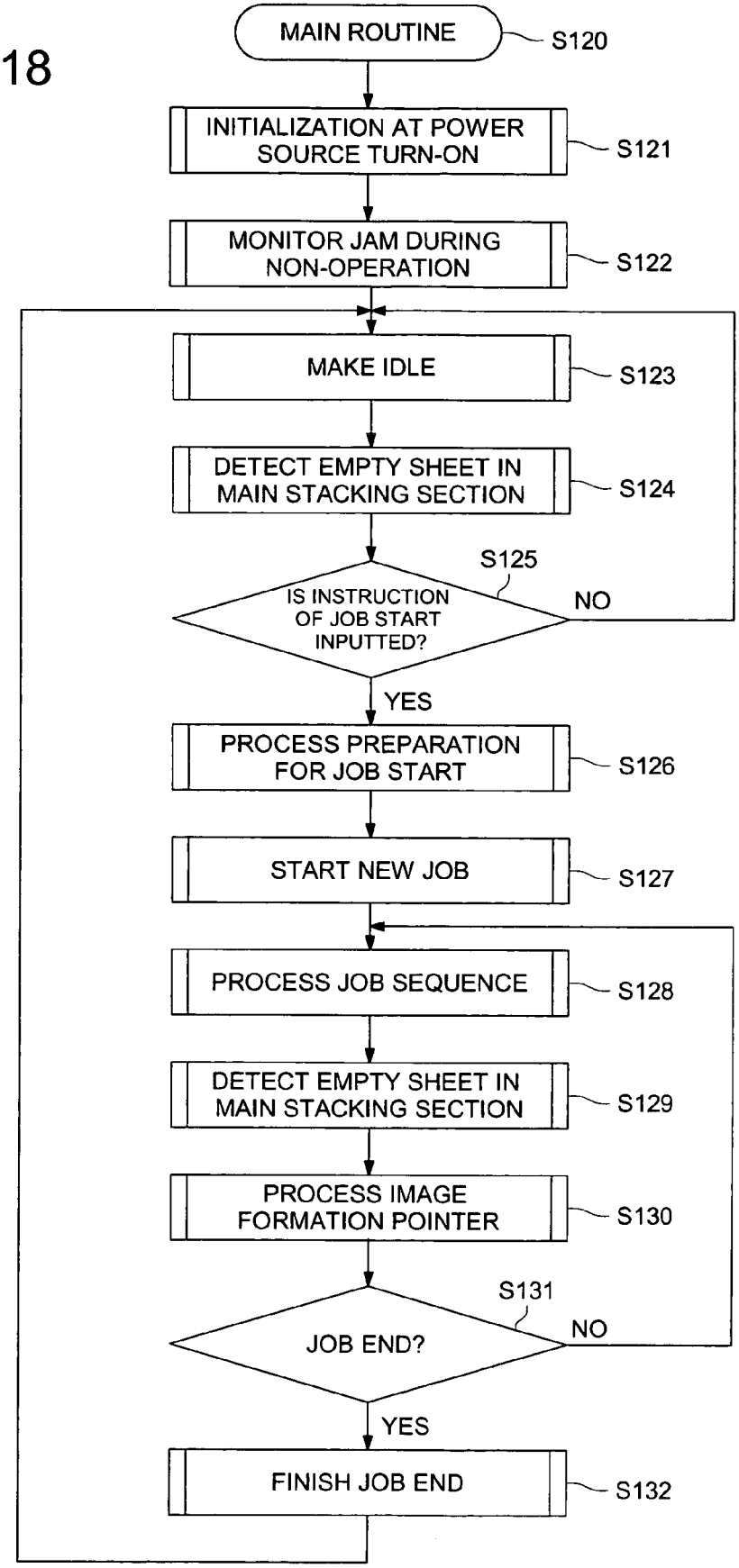
FIG. 18 is a flowchart showing the main routine of an example of the sequence change method used in the image forming system shown in FIG. 1.

FIG. 18 is a flowchart showing the main routine of the sequence change method used in the control device 35 of the image forming apparatus 2. When power is supplied to the entire image forming system 1, the control device 35 starts the main routine (Step S120) to perform initialization at the time of power supply (Step S121) and to monitor a paper jam in the non-operation mode (Step S122). Upon completion of the jam monitoring in the non-operation mode, the control device 35 applies processing of idling, and the image forming apparatus 2, first stacking device 40A and second stacking device 40B are brought to an idle state (Step S123). After processing of idling, the control device 35 checks if the main stacking section is empty or not (Step S124).

Figure 19:
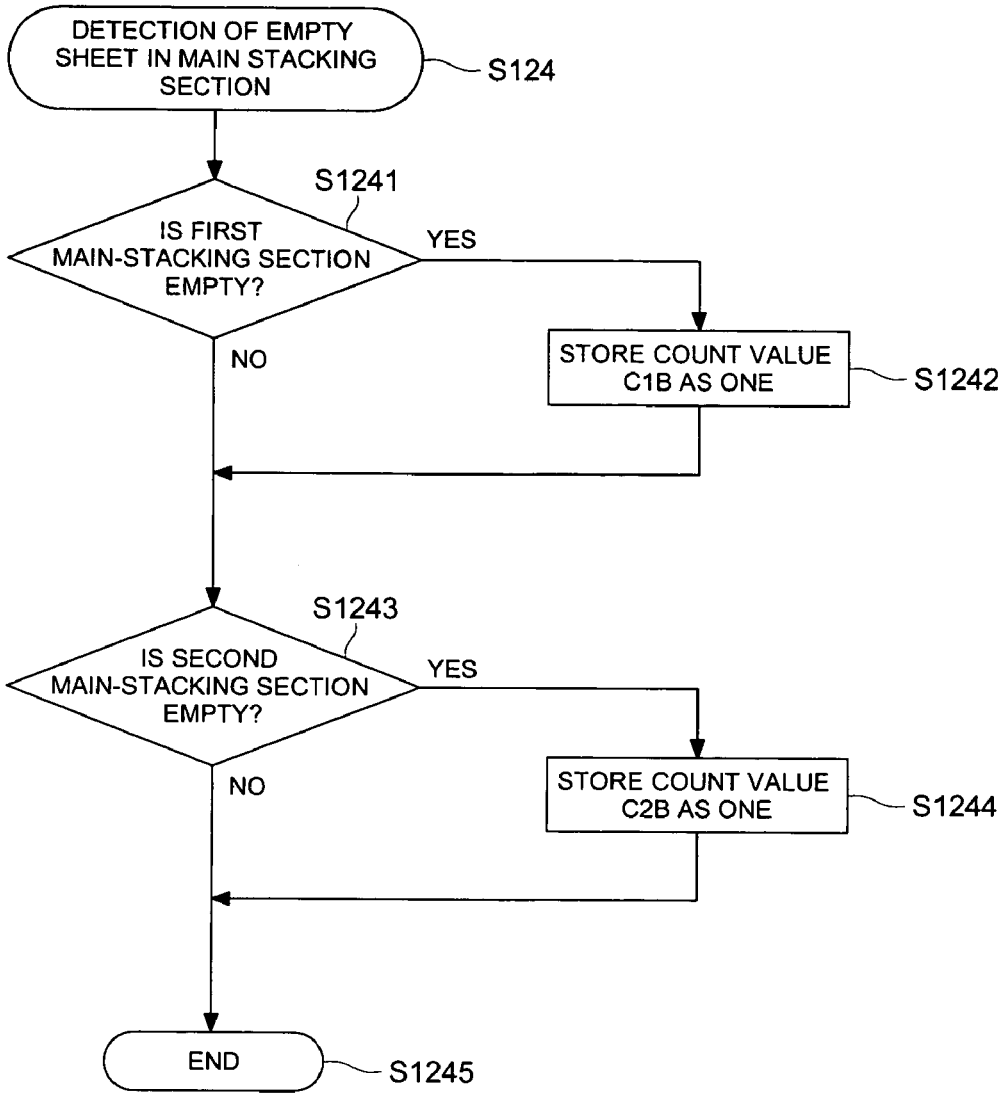
FIG. 19 is a flowchart showing the processing of checking whether the main stacking section is empty or not, in the main routine shown in FIG. 18.

FIG. 19 is a flowchart showing the processing of checking whether the main stacking section is empty or not. In this processing, detection is made to check if the first main-stacking section 41A and second main-stacking section 41B are empty or not. If they are empty, the counts C1B and C2B are preset to "1". To put it in greater details, as shown in FIG. 19, the control device 35 checks if the number of sheets stacked in the first main-stacking section 41A is "0" or not, according to the result of detecting by the first sheet presence detection section 44A (Step S1241). If it is "0", the control device 35 goes to Step S1242, and stores the count C1B of the first sheet counter 55A as "1" in the memory 38. As described above, the control device 35 presets the count C1B and proceeds to the Step S1243.

When the control goes to the Step S1243, the control device 35 checks if the number of sheets stacked on the second main-stacking section 41B is "0" or not. If it is not "0", the control device 35 proceeds to the Step S1245 and terminates the processing of checking if the main stacking section is empty or not. If it is "0", the control device 35 proceeds to the Step S1244, and stores the count C2B of the second sheet counter 55B as "1" in the memory 38. As described above, the control device 35 presets the count C2B, goes to the Step S1245 and terminates the processing of checking if the main stacking section is empty or not.

After completing the processing of checking if the main stacking section is empty or not, the control device 35 checks if the job start instruction has been inputted or not, as shown in FIG. 18 (Step S125). The control device 35 goes to the Step S123 when no instruction is inputted. If the instruction is inputted, it proceeds to the Step S126 and applies the processing of startup at the time of job start so that the image forming apparatus 2, first stacking device 40A and second stacking device 40B will respond to the sob start instruction (Step S126). The processing of startup at the time of job start refers to the general processing applied at the time of starting the job. For example, it includes clearing of the plug and counter used during the job, and execution of the initial sequence (e.g. starting of the main motor). Upon completion of processing the startup at the time of job start, the control device 35 applies the processing of starting a new job (Step S127).

Figure 20:
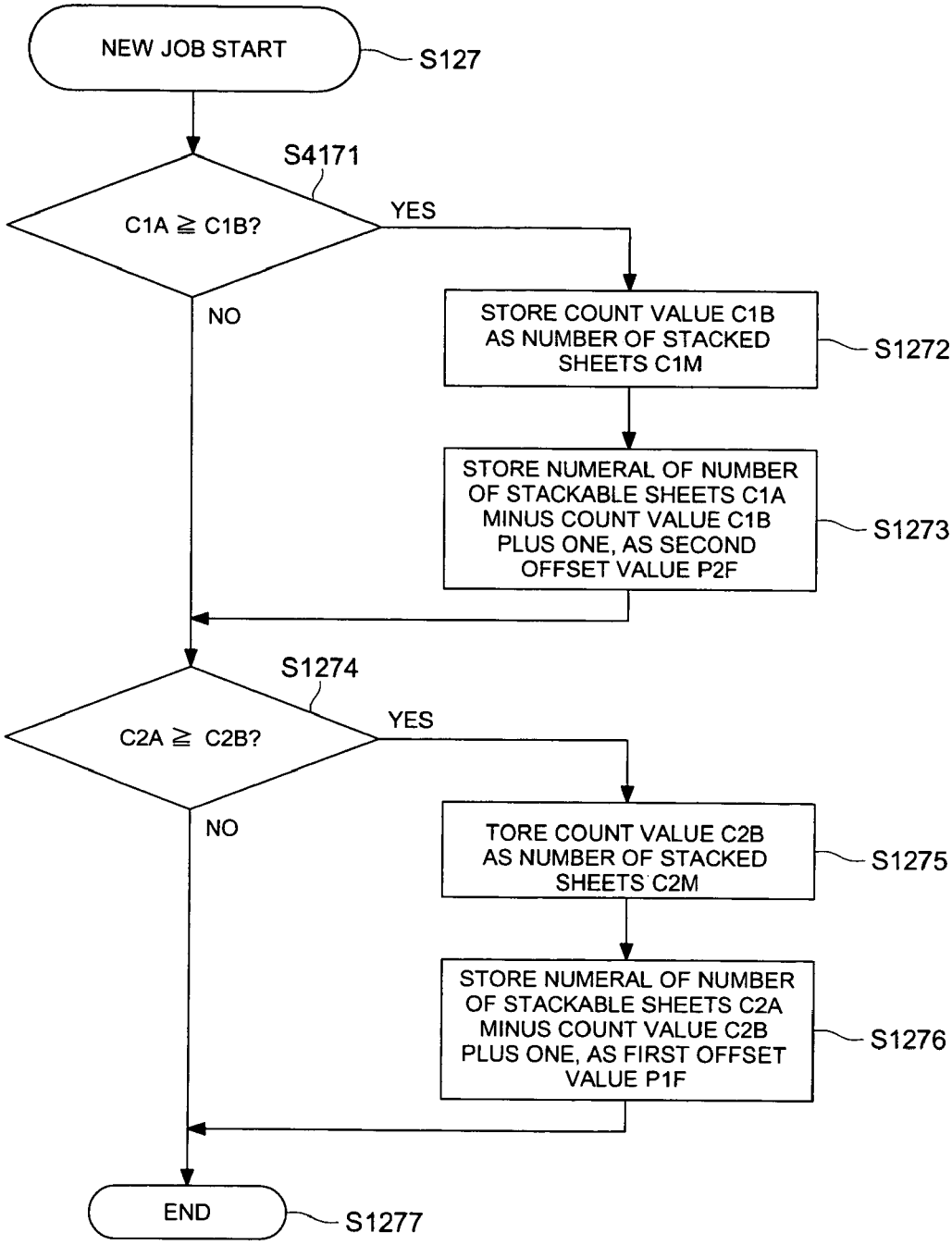
FIG. 20 is a flowchart showing the processing of a new job start in the main stacking section of the main routine shown in FIG. 18.

FIG. 20 is a flowchart showing the processing of a new job start. In the processing of new job start, if the first main-stacking section 41A and second main-stacking section 41B are not fully loaded, the current counts C1B and C2B are stored as the numbers of stacked sheets C1M and C2M at the time of startup. Further, the counts up to the full load ((C1A−C1B+1), (C2A−C2B+1)) are stored as offsets P1F and P2F when switching occurs between the first main-stacking section 41A and second main-stacking section 41B. To put it in greater details, as shown in FIG. 20, the control device 35 checks whether or not the count C1B of the first sheet counter 55A stored in the memory 38 is smaller than the number of sheets C1A loadable on the first main-stacking section 41A (Step S1271). If it is smaller, the control goes to Step S1272. If it is equal to or greater, the control goes to Step S1274.

In Step S1272, the control device 35 allows the memory 38 to store the count C1B as the number of sheets C1M stacked on the first stacking device 40A, and proceeds to Step S1273.

In the Step S1273, the control device 35 allows the memory 38 to store the value obtained by subtracting the count C1B of the first sheet counter 55A from the number of sheets C1A loadable on the first main-stacking section 41A and by adding "1" to the result, as the second offset P2F. Then the control device 35 proceeds to the Step S1274.

In the Step S1274, the control device 35 checks whether or not the C2B of the second sheet counter 55B stored in the memory 38 is smaller than the number of sheets C2A loadable on the first main-stacking section 41A. If it is smaller, the control goes to Step S1275. If it is equal to or greater, the control goes to Step S1277 to terminate the processing of a new job start.

In the Step S1275, the control device 35 allows the memory 38 to store the count C2B as the number of sheets C2M stacked of the second stacking device 40B, and proceeds to the Step S1276.

In the Step S1276, the control device 35 allows the memory 38 to store the value obtained by subtracting the count C2B of the second sheet counter 55B from the number of sheets C2A loadable on the second main-stacking section 41B and by adding "1" to the result, as the first offset P1F. Then the control device 35 proceeds to the Step S1277 to terminate the processing of a new job start.

Upon completion of the processing of a new job start, the control device 35 processes the job sequence, based on one of the image data items in the job, as shown in FIG. 18 (Step S128), and then checks again if the main stacking section is empty or not (Step S129). This checking is carried out under the same control as that of the Step S124. The processing of job sequence can be defined as the general processing in which job sequence is processed. For example, it includes electrophotographic processing. Upon completion of processing of checking if the main stacking section is empty or not, the control device 35 proceeds to the Step S130 to apply processing of an image forming pointer.

Figure 21:
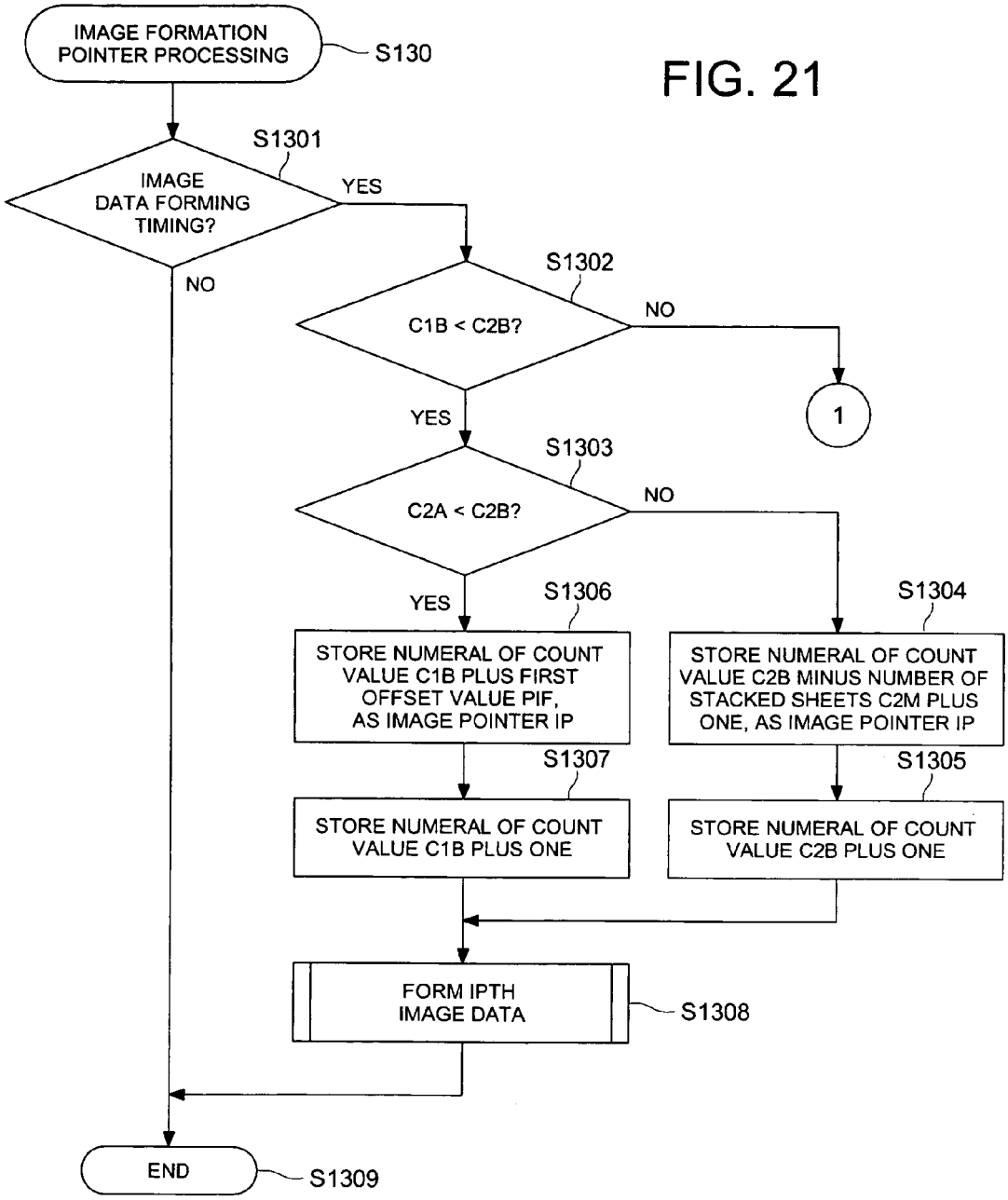
FIG. 21 is a flowchart showing the processing of an image forming pointer in the main routing shown in FIG. 18.
Figure 22:
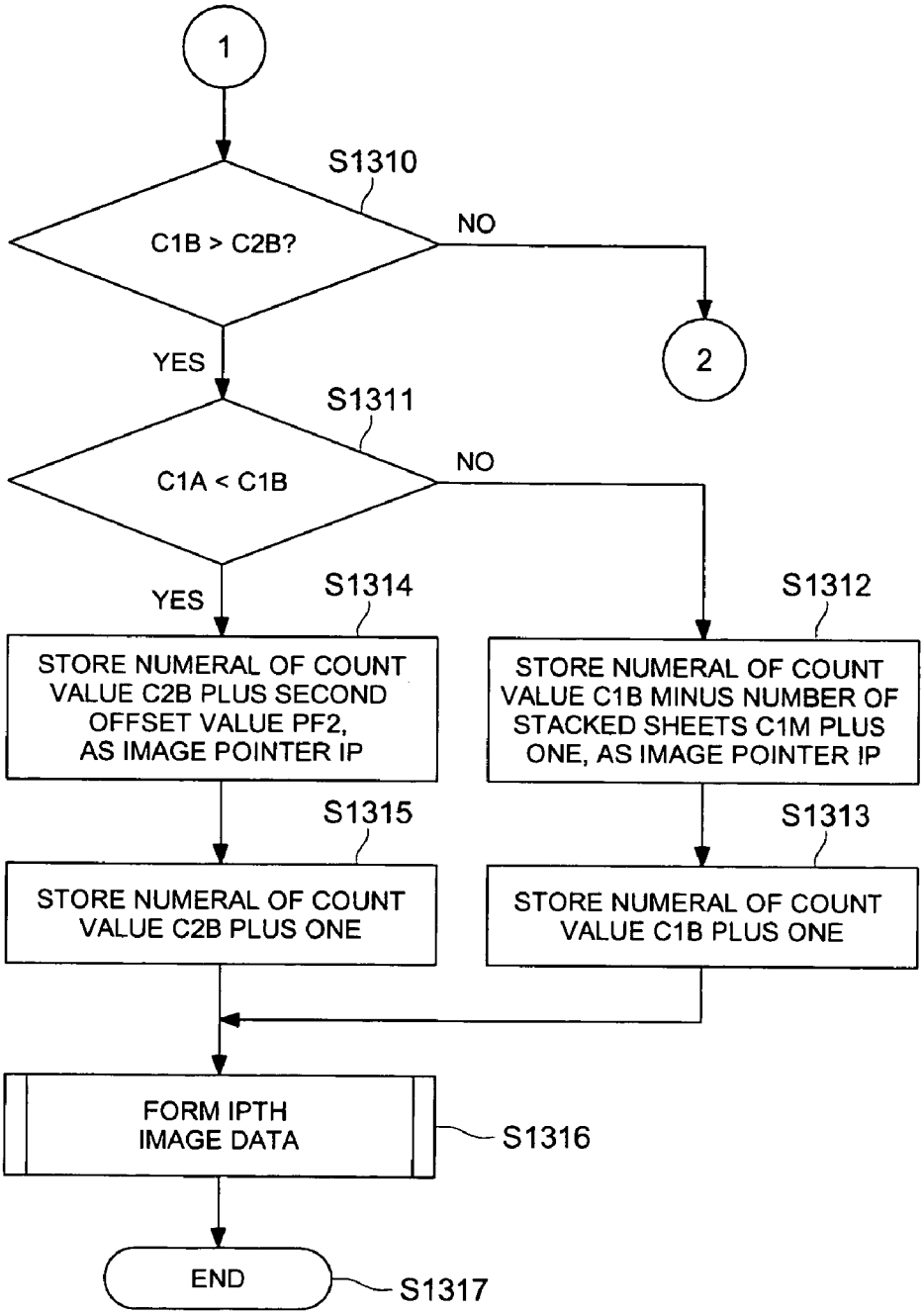
FIG. 22 is a flowchart showing the continuation of the processing of the image forming pointer shown in FIG. 21.
Figure 23:
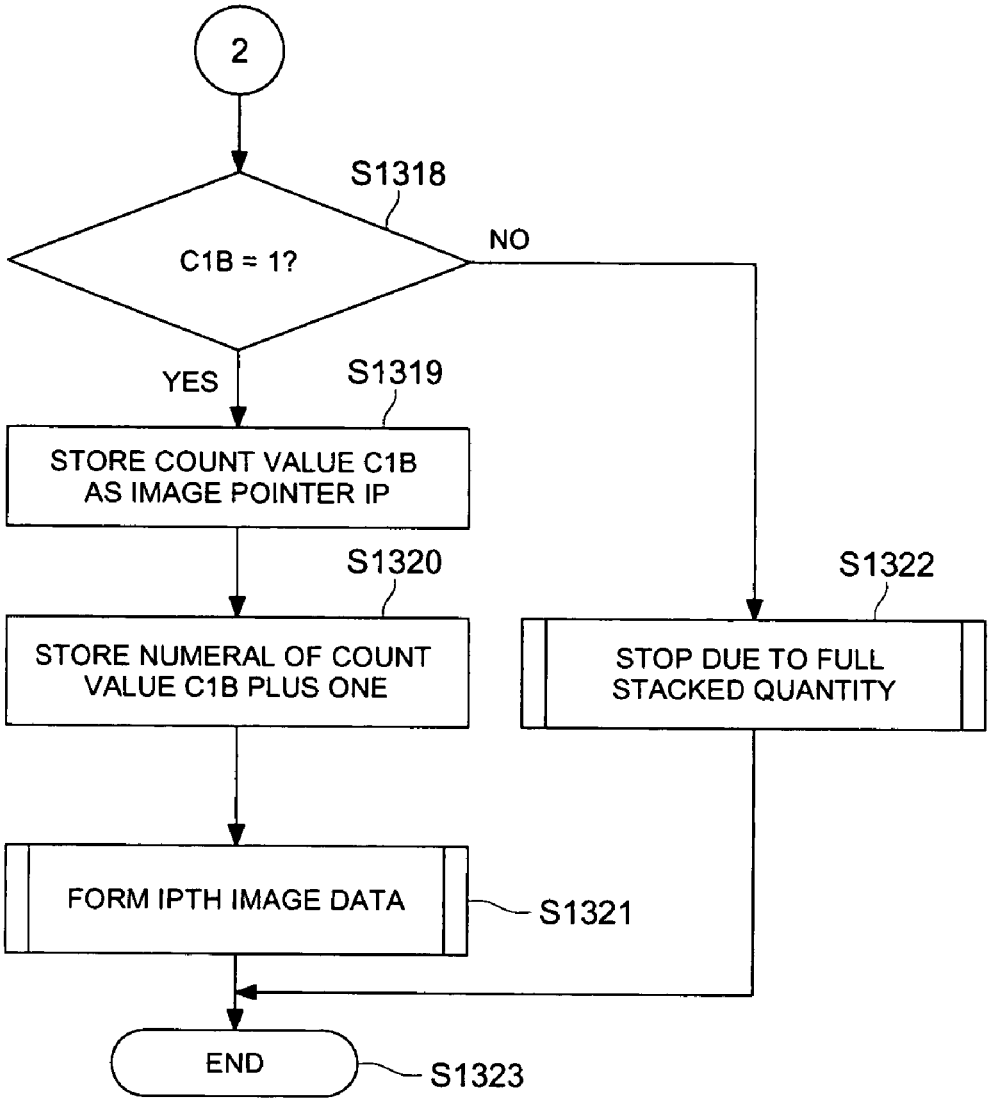
FIG. 23 is a flowchart showing the continuation of the processing of the image forming pointer shown in FIG. 22.

FIGS. 21 through 23 are flowcharts showing the processing of an image forming pointer. Processing of an image forming pointer can be defined as computational processing of determining the ordinal position of the sheet corresponding to each of a plurality of image data items. In this case, assume that, whenever each of the first main-stacking section 41A and second main-stacking section 41B is filled with paper, paper is always removed so that these stacking sections will be empty. Then the count C1B of the first main-stacking section 41A and C2B of the second main-stacking section 41B are compared, and the stacking section having a greater value generally is the destination of sheet conveyance prior to switching (either the first main-stacking section 41A or second main-stacking section 41B: the destination prior to switching will be called "main stacking section prior to switching" and the destination subsequent to switching will be called "main stacking section subsequent to switching" hereinafter). Thus, the control device 35 checks if the main stacking section prior to switching is fully loaded or not. If it is not fully loaded, the ordinal position of the sheet of paper P corresponding to the image data item is calculated from the difference between the current counts C1B and C2B of the main stacking section prior to switching, and the numbers of loaded sheets C1M and C2M. If it is fully loaded, the ordinal position of the sheet of paper P corresponding to the image data item is calculated, based on the sum between the current counts C1B and C2B of the main stacking section subsequent to switching and the offsets P1F and P2F. Upon completion of the aforementioned process, the current counts C1B and C2B are advanced by "1". To put it in greater details, as shown in FIG. 21, in the processing of an image forming pointer, the control device 35 checks if this is the time for generation of image data (Step S1301). In this case, image data generation can be defined as setting of the image pointer IP with respect to the image data of a job. If this is the timing for the image data generation for the job, the control device 35 proceeds to the Step S1302. If not, the control device 35 proceeds to the Step S1309 when image data generation is completed. Then the processing of image forming pointer terminates.

In the Step S1302, the main stacking section prior to switching is determined. In this case, the control device 35 checks if the count C1B of the first sheet counter 55A is less than the count C2B of the second sheet counter 55B. If the C1B is less, the second main-stacking section 41B is determined as the main stacking section prior to switching, and the control device 35 proceeds to the Step S1303. If the count C1B of the first sheet counter 55A is not less than the count C2B of the second sheet counter 55B, the control device 35 keeps the main stacking section prior to switching unspecified, and proceeds to the Step S1310 shown in FIG. 22.

In the Step S1303, the control device 35 checks whether or not the second main-stacking section 41B is fully loaded. In this case, the control device 35 checks if the number of sheets C2A loadable on the second main-stacking section 41B is less than the count C2B of the second sheet counter 55B. If it is not less than the count C2B of the second sheet counter 55B, the second main-stacking section 41B is fully loaded. The control device 35 proceeds to the Step S1304. If it is less, the second main-stacking section 41B is not fully loaded, and the control device 35 proceeds to the Step S1306.

In Step S1304, the control device 35 allows the memory 38 to store the value obtained by subtracting the count C2M of the second main-stacking section 41B from the number of sheets C2B stored in the memory 38 and by adding "1" to the result, as the image pointer IP. Then the control device 35 proceeds to the Step S1305.

In Step S1305, the control device 35 allows the count C2B to be incremented by "1". After the count C2B subsequent to counting up has been stored in the memory 38, the control device 35 proceeds to the Step S1308.

In the Step S1306, after the value obtained by adding the first offset P1F to the count C1B stored in the memory 38 has been stored in the memory 38 as the image pointer IP, the control device 35 proceeds to the Step S1307.

In Step S1307, the control device 35 allows the count C1B to be incremented by "1". After the count C1B subsequent to counting up has been stored in the memory 38, the control device 35 proceeds to the Step S1308.

In the Step S1308, the control device 35 allows the previously set image pointer IP to be set as image data, and proceeds to the Step S1309 to terminate the processing of an image forming pointer.

After moving from the Step S1302 to the Step S1310 shown in FIG. 22, the control device 35 determines the main stacking section prior to switching. Thus, the control device 35 checks whether or not the count C1B of the first sheet counter 55A is greater than the count C2B of the second sheet counter 55B. If it is greater, the control device 35 determines the first main-stacking section 41A as the main stacking section prior to switching, and proceeds to the Step S1311. If it is not greater, i.e. if the count C1B of the first sheet counter 55A is the same as the count C2B of the second sheet counter 55B, the control device 35 keeps the main stacking section prior to switching unspecified, and proceeds to the Step S1318 shown in FIG. 23.

In the Step S1311, the control device 35 checks whether or not the first main-stacking section 41A is fully loaded. In this case, the control device 35 checks if the number of sheets C1A loadable on the first main-stacking section 41A is less than the count C1B of the first sheet counter 55A. If it is not less than the count C1B of the first sheet counter 55A, the first main-stacking section 41A is fully loaded. The control device 35 proceeds to the Step S1312. If it is less, the first main-stacking section 41A is not fully loaded, and the control device 35 proceeds to the Step S1314.

In the Step S1312, the control device 35 allows the memory 38 to store the value obtained by subtracting the number of sheets C1M stacked of the first stacking device 41A from the count C1B of the first sheet counter 55A stored in the memory 38 and by adding "1" to the result, as the image pointer IP. Then the control device 35 proceeds to the Step S1313.

In Step S1313, the control device 35 allows the count C1B to be incremented by "1". After the count C1B subsequent to counting up has been stored in the memory 38, the control device 35 proceeds to the Step S1316.

In the Step S1314, after the value obtained by adding the second offset P2F to the count C2B stored in the memory 38 has been stored in the memory 38 as the image pointer IP, the control device 35 proceeds to the Step S1315.

In Step S1316, the control device 35 allows the count C2B to be incremented by "1". After the count C2B subsequent to counting up has been stored in the memory 38, the control device 35 proceeds to the Step S1316.

In the Step S1316, the control device 35 allows the previously set image pointer IP to be set with respect to image data, and proceeds to the Step S1317 to terminate the processing of the image forming pointer.

After moving from the Step S1310 to the Step S1318 shown in FIG. 23, the control device 35 checks if the count C1B of the first sheet counter 55A is "1" or not. To put it another way, in Step S1318, the control device 35 checks if both the first main-stacking section 41A and second main-stacking section 41B are fully loaded, or there is no sheet of paper loaded therein.

If the count C1B is not "1", the control device 35 considers that both the first main-stacking section 41A and second main-stacking section 41B are fully loaded, and proceeds to the Step S1322 to perform processing of stopping due to full load. Then it proceeds to the Step S1323 to terminate the processing of the image forming pointer.

In the meantime, when the count C1B is "1", the control device 35 considers that there is no sheet of paper loaded on either the first main-stacking section 41A or second main-stacking section 41B, and proceeds to the Step S1319. In the Step S1319, the control device 35 allows the memory 38 to store the count C1B as the image pointer IP, and proceeds to the Step S1320. In the Step S1320, the control device 35 allows the count C1B to be incremented by "1". After the count C1B subsequent to counting up has been stored in the memory 38, the control device 35 proceeds to the Step S1321.

In the Step S1321, the control device 35 allows the previously set image pointer IP to be set with respect to image data, and proceeds to the Step S1323 to terminate the processing of the image forming pointer.

Upon completion of the processing of the image forming pointer, as shown in FIG. 18, the control device 35 proceeds to the Step S131 to perform general job end checks, and checks if all the job sequence for covering the preset number of sheets has been completed or not. If the preset number of sheets has not yet been reached, it proceeds to the Step S128.

If the preset number of sheets has been reached, it proceeds to the Step S132.

The transition of each value when an image pointer IP is set-for all image data included in one job is shown in Table 1, when a job having ten image data items has been executed, for example, on the assumption that each of the numbers of sheets C1A loadable on the first main-stacking section 41A and the number of sheets C2A loadable on the second main-stacking section 41B is 1000, the number of sheets loaded on the first main-stacking section 41A is zero (where C1M indicates "1"), and that of the second main-stacking section 41B is 997 ((where C2M indicates "998").

TABLE 1

| IP | C1A | C1B | C1M | P1F | C2A | C2B | C2M | P2F |
|---|---|---|---|---|---|---|---|---|
| 01 | 1000 | 01 | 01 | 03 | 1000 | 998 | 998 | 1000 |
| 02 | 1000 | 01 | 01 | 03 | 1000 | 999 | 998 | 1000 |
| 03 | 1000 | 01 | 01 | 03 | 1000 | 1000 | 998 | 1000 |
| 04 | 1000 | 01 | 01 | 03 | 1000 | 1001 | 998 | 1000 |
| 05 | 1000 | 02 | 01 | 03 | 1000 | 1001 | 998 | 1000 |
| 06 | 1000 | 03 | 01 | 03 | 1000 | 1001 | 998 | 1000 |
| 07 | 1000 | 04 | 01 | 03 | 1000 | 1001 | 998 | 1000 |
| 08 | 1000 | 05 | 01 | 03 | 1000 | 1001 | 998 | 1000 |
| 09 | 1000 | 06 | 01 | 03 | 1000 | 1001 | 998 | 1000 |
| 10 | 1000 | 07 | 01 | 03 | 1000 | 1001 | 998 | 1000 |

In the Step S132, the control device 35 proceeds to the Step S123 upon completion of termination processing at the time of job end.

In this case, when restarting image formation subsequent to clearing of the jammed paper when the N-th sheet of paper P is jammed in the second conveyance path and (N+1)th sheet of paper P is ejected to the first main-stacking section 41A, the control device 35 controls in such a way as to restart image formation from the image corresponding to the N-th subsequent sheets, except for the image formed on the (N+1)th sheet of paper P ejected to the first main-stacking section 41A by the image forming section 29. Especially when restarting image formation subsequent to clearing of the jammed paper when the N-th sheet of paper P is jammed in the second conveyance path and M-th sheet of paper P with an image formed thereon before the stop of the image forming section 29 is ejected to the first main-stacking section 41A, the control device 35 controls in such a way as to restart image formation from the image corresponding to the N-th subsequent sheets, except for the image formed on the (N+1)th sheet of paper P ejected to the first main-stacking section 41A by the image forming section 29.

Thus, even if a paper jam has occurred, this arrangement eliminates the possible duplication of the sheets with the same image formed thereon, after the jammed paper has been cleared. Therefore, this arrangement ensures sheets to be stacked according to the order of stacking even if a paper jam has occurred, and prevents the order of stacking from being disturbed while reducing the operator workload. Further, this arrangement prevents duplication of sheets with the same image formed thereon after clearing of jammed paper, without wasting M sheets of paper P with an image formed thereon before clearing of jammed paper.

Further, if the N-th sheet of paper P is jammed along the second conveyance path and a sheet with an image formed thereon is included in the (N+1)th and subsequent sheets, the image forming section 29 is stopped after the sheet with an image formed thereon has been ejected to the first main-stacking section 41A in order to ensure that the aforementioned sheet with an image formed thereon is not left behind along the common conveyance path or the first conveyance path. This arrangement prevents a new image from being formed on paper after a paper jam occurs, and a sheet with an image formed thereon, included in the (N+1)th and subsequent sheets, is ejected to the first main-stacking section 41A and is prevented from being left behind along the common and first conveyance paths.

Without being restricted to the aforementioned embodiments, the present invention can be embodied in a great number of improvements and engineering modifications without departing from the technological spirit and scope of the invention claimed.

For example, in the first and second embodiments, two stacking sections, namely the first main-stacking section 41A of the first stacking device 40A and second main-stacking section 41B of the second stacking device 40B are illustrated as stacking sections arranged at different positions. The aforementioned arrangement is also applicable to the case where three stacking sections are provided. In the present embodiment, first stacking device 40A and second stacking device 40B as stacking devices are used. It is also possible to utilize a sorter type device or a stacker and sorter device. When the sorter type is used, the bin provided thereon is employed as a stacking section.

In this case, when an image is formed on each sheet by the image forming section 29 and the first sheet switching section 52A is switched so that the sheets of paper P up to the N-th sheet and the (N+1)th and subsequent sheets of paper P will be loaded on different stacking sections, the interval between the N-th sheet and (N+1)th sheet is greater than the interval between sheets of paper P fed to one and the same stacking section. Thus, the interval between sheets is greater during the operation of the first sheet switching section 52A than that otherwise. This arrangement ensures more reliable switching of the first sheet switching section 52A, thereby avoiding a paper jam.

In the wait mode illustrated in the first embodiment, when an image is recorded on the paper P in the wait state, one and the same image may be recorded after a paper jam. Therefore, in the operation of image formation subsequent to clearing of jammed paper, a sequence change method is utilized to eliminate this possibility.

Further, paper is fed at a high speed except when the destination is switched. Just before the destination is switched, an image is formed on the (N+1)th and subsequent sheets of paper P after the (N+1)th sheet of paper P is loaded on the second main-stacking section 41B. When this arrangement is adopted, no image is formed on the paper P in the wait state. Then even if the (N+1)th sheet is jammed, image formation is restarted from the image corresponding to the N-th sheet of paper P, after clearing of the jammed paper. This method allows the sheets of paper P to be stacked according to a predetermined order, without using the sequence change method. To put it another way, this arrangement provides less complicated image formation control after restart. To put it more specifically, if means are provided to control the interval timed for supplying paper P from the sheet storing sections 21 and 22 by the sheet feed sections 23 and 24, an image can be recorded on the (N+1)th and subsequent sheets after the N-th sheet of paper P has been stacked on the second main-stacking section 41B.

It is also possible to arrange such a configuration that the interval between the N-th sheet of paper P and (N+1)th sheet of paper P is different between the case where first sheet switching section 52A has been selected in such a way that the N-th sheet of paper P with an image formed thereon is conveyed along the second conveyance path, and the (N+1)th sheet of paper P with an image formed thereon is conveyed along the first conveyance path during continuous image formation, and the case where the first sheet switching section 52A has been selected in such a way that the N-th sheet of paper P with an image formed thereon is conveyed along the first conveyance path, and the (N+1)th sheet of paper P with an image formed thereon is conveyed along the second conveyance path during continuous image formation. For example, when first sheet switching section 52A has been selected in such a way that the N-th sheet of paper P with an image formed thereon is conveyed along the second conveyance path, and the (N+1)th sheet of paper P with an image formed thereon is conveyed along the first conveyance path, the interval between the N-th sheet of paper P and the (N+1)th sheet of paper P is set longer. Then this arrangement permits the (N+1)th sheet of paper P to be stacked on the first main-stacking section 41A after the N-th sheet of paper P has been stacked on the second main-stacking section 41B. If the N-th sheet of paper P is jammed along the second conveyance path, the (N+1)th sheet of paper P is not loaded on the first main-stacking section 41A. To put it another way, even if image formation is restarted after clearing of a jammed paper, the order of stacking from being disturbed can be avoided by controlling the order of subsequent image formation.

What is claimed is:

1. An image forming system comprising:

(a) an image forming section for forming an image on a sheet;

(b) a first stacking section for stacking the sheet with the image formed thereon by the image forming section;

(c) a second stacking section provided at a position different from the first stacking section for stacking the sheet with the image formed thereon by the image forming section;

(d) a common conveyance path for conveying the sheet with the image formed thereon by the image forming section;

(e) a first conveyance path for conveying the sheet conveyed along the common conveyance path, to the first stacking section;

(f) a second conveyance path longer than the first conveyance path for conveying the sheet conveyed along the common conveyance path, to the second stacking section, wherein an interval between adjoining sheets fed along the common conveyance path is smaller than a difference between the second and first conveyance paths, when images are formed on the sheets continuously one by one by the image forming section;

(g) a switching section for switching a conveyance path of the sheet conveyed along the common conveyance path between the first conveyance path and the second conveyance path; and (h) a control device controls such that when the switching section is selected in such a way that an N-th sheet with an image formed thereon is conveyed along the second conveyance path, and an (N+1)th sheet with an image formed thereon is conveyed along the first conveyance path during continuous image formation, the controller controls the (N+1)th sheet so that an arrival timing of the (N+1)th sheet at the first stacking section is delayed without stopping the continuous image formation by the image forming section, and the (N+1)th sheet is thereby stacked on the first stacking section after the N-th sheet has been stacked on the second stacking section, where N represents a natural number.

2. The image forming system of claim 1, wherein the control device controls to make an interval between the N-th sheet and (N+1)th sheet to be greater than an interval between adjoining sheets fed continuously to one of the first and second stacking sections, whereby the (N+1)th sheet is stacked on the first stacking section after the N-th sheet has been stacked on the second stacking section.

3. The image forming system of claim 2, wherein the image forming section comprises a sheet storing section for storing a plurality of sheets, and a sheet feed section for feeding sheets one by one from the sheet storing section, and forms an image on each of the sheets fed out by the sheet feed section, and wherein the control device makes an interval between the N-th sheet and the (N+1)th sheet to be greater than an interval between adjoining sheets fed continuously to one of the first and second stacking sections by controlling a sheet feed timing of the sheet feed section, whereby the (N+1)th sheet is stacked on the first stacking section after the N-th sheet has been stacked on the second stacking section.

4. The image forming system of claim 1, further comprising a suspension mechanism for suspending a sheet on the common conveyance path or the first conveyance path, wherein the control device controls the suspension mechanism to suspend the sheet so that the (N+1)th sheet is stacked on the first stacking section, after the N-th sheet has been stacked on the second stacking section.

5. The image forming system of claim 4 wherein the suspension mechanism suspends the sheet by stopping a conveyance of the (N+1)th sheet.

6. The image forming system of claim 5, wherein the suspension mechanism suspends the sheet by superimposing at least one of an (N+2)th and subsequent sheets on the (N+1)th sheet being suspended, and stopping, whereby the suspension mechanism suspends the sheet.

7. The image forming system of claim 4, wherein the suspension mechanism suspends the sheet by decelerating a conveyance of the (N+1)th sheet.

8. The image forming system of claim 1, wherein when the N-th sheet is jammed in the second conveyance path, the control device stops a conveyance of the (N+1)th sheet, without permitting the (N+1)th sheet to be stacked on the first stacking section.

9. The image forming system of claim 8, wherein after clearing the jammed N-th sheet, the control device restarts image formation from an image corresponding to the N-th and subsequent sheets, and controls such that the N-th sheet is stacked on the second stacking section and the (N+1)th sheet is stacked on the first stacking section.

10. The image forming system of claim 1, wherein the control device controls to make an interval between the (N+1) th sheet and the N-th sheet to be different between: when the switching section has been selected such that the N-th sheet with an image formed thereon is conveyed along the second conveyance path, and the (N+1)th sheet with an image formed thereon is conveyed along the first conveyance path during continuous image formation; and when the switching section has been selected such that the N-th sheet is conveyed along the first conveyance path, and the (N+1)th sheet is conveyed along the second conveyance path during continuous image formation.

11. An image forming system comprising:

(a) an image forming section for forming an image on a sheet;

(b) a first stacking section for stacking the sheet with the image formed thereon by the image forming section;

(c) a second stacking section provided at a position different from the first stacking section for stacking the sheet with the image formed thereon by the image forming section;

(d) a common conveyance path for conveying the sheet with the image formed thereon by the image forming section;

(e) a first conveyance path for conveying the sheet conveyed along the common conveyance path, to the first stacking section;

(f) a second conveyance path longer than the first conveyance path for conveying the sheet conveyed along the common conveyance path, to the second stacking section, wherein an interval between adjoining sheets fed along the common conveyance path is smaller than a difference between the second and first conveyance paths; when images are formed on the sheets continuously one by one by the image forming section;

(g) a switching section for switching a conveyance path of the sheet conveyed along the common conveyance path between the first conveyance path and the second conveyance path; and (h) a control device for controlling such that; when images are formed on continuous N-th sheet (N: natural number) and (N+1)th sheet, and the switching section is selected such that the N-th sheet is fed along the second conveyance path and the (N+1)th sheet is fed along the first conveyance path, and when the N-th sheet is jammed along the second conveyance path and the (N+1)th sheet is ejected to the first stacking section and image formation is restarted after the jammed N-th sheet has been cleared; the control device controls in such a way that the image forming section restarts the image formation from an image corresponding to the N-th and subsequent sheets, except for an image that has already been formed on the (N+1)th sheet and ejected to the first stacking section; and the sheet with an image corresponding to the N-th sheet formed thereon is fed along the second conveyance path by the switching section.

12. The image forming system of claim 11, wherein the control device controls in such a way that, when the N-th sheet is jammed along the second conveyance path and a sheet with an image which has been formed thereon is included in the (N+1)th and subsequent sheets, the image forming section is stopped after the sheet included in the (N+1)th and subsequent sheets has been ejected to the first stacking section to ensure that the sheet included in the (N+1)th and subsequent sheets is not left along the common conveyance path and the first conveyance path.

13. The image forming system of claim 11, wherein when the switching section is selected in such a way that the N-th sheet is fed along the second conveyance path and the (N+1)th sheet is fed along the first conveyance path, and when the N-th sheet is jammed along the second conveyance path, and M sheets on which images have been formed are ejected to the first stacking section until the image formation is stopped, and after the jammed N-th sheet is cleared, the control device controls in such a way that the control section restarts image formation from an image corresponding to the N-th sheet and (N+M1)th and subsequent sheets; and the sheet with an image corresponding to the N-th sheet formed thereon by the switching section is fed to the second conveyance path; and the sheets with an image corresponding to the (N+M+1)th and subsequent sheets are fed to the first conveyance path, where M represents a natural number.

14. The image forming system of claim 1, wherein the control section controls in such a way that when images are continuously formed on each of sheets by the image forming section, and the switching second is selected to ensure that the sheets up to the N-th sheet with an image formed thereon and the (N+1)th and subsequent sheets with an image formed thereon are fed to different stacking sections, an interval between the N-th sheet and (N+1)th sheet is greater than that when sent to the same stacking section.

15. An image forming method used in an image forming system comprising: an image forming section for forming an image on a sheet; a first stacking section for stacking the sheet with the image formed thereon by the image forming section; a second stacking section provided at a position different from the first stacking section for stacking the sheet with the image formed thereon by the image forming section; a common conveyance path for conveying the sheet with the image formed thereon by the image forming section; a first conveyance path for conveying the sheet conveyed along the common conveyance path, to the first stacking section; a second conveyance path longer than the first conveyance path for conveying the sheet conveyed along the common conveyance path, to the second stacking section, wherein an interval between adjoining sheets fed along the common conveyance path is smaller than a difference between the second and first conveyance paths, when images are formed on the sheets continuously one by one by the image forming section; and a switching section for switching a conveyance path of the sheet conveyed along the common conveyance path between the first conveyance path and the second conveyance path, the image forming method comprising the steps of:

stacking an N-th sheet on the second stacking section; and then stacking an (N+1)th sheet on the first stacking section so that an arrival timing of the (N+1)th sheet at the first stacking section is delayed without stopping the continuous image formation by the image forming section, when the switching section is selected in such a way that the N-th sheet with an image formed thereon is conveyed along the second conveyance path, and the (N+1)th sheet with an image formed thereon is conveyed along the first conveyance path during continuous image formation, where N represents a natural number.

16. The image forming method of claim 15, further comprising the step of making an interval between the N-th sheet and (N+1)th sheet to be greater than an interval between adjoining sheets fed continuously to one of the first and second stacking sections, whereby the (N+1)th sheet is stacked on the first stacking section after the N-th sheet has been stacked on the second stacking section.

17. The image forming method of claim 16, wherein the image forming section comprises a sheet storing section for storing a plurality of sheets, and a sheet feed section for feeding sheets one by one from the sheet storing section; and forms an image on each of the sheets fed out by the sheet feed section;

the image forming method comprising:

controlling a sheet feed timing of the sheet feed section to make the interval between the N-th sheet and (N+1)th sheet to be greater than the interval between adjoining sheets fed continuously to one of the first and second stacking sections, whereby the (N+1)th sheet is stacked on the first stacking section after the N-th sheet has been stacked on the second stacking section.

18. The image forming method of claim 15, wherein the image forming system further comprises a suspension mechanism for suspending a sheet on the common conveyance path or the first conveyance path, the image forming method comprising:

suspending a sheet in the suspension mechanism, whereby the (N+1)th sheet is stacked on the first stacking section, after the N-th sheet has been stacked on the second stacking section.

19. The image forming method of claim 18, further comprising the step of stopping a conveyance of the (N+1)th sheet, whereby the suspension mechanism suspends the sheet.

20. The image forming method of claim 19, further comprising the step of superimposing at least one of an (N+2)th and subsequent sheets on the (N+1)th sheet being suspended, and stopping, whereby the suspension mechanism suspends the sheet.

21. The image forming method of claim 18, further comprising the step of decelerating a conveyance of the (N+1)th sheet, whereby the suspension mechanism suspends the sheet.

22. The image forming method of claim 15, further comprising the step of, when the N-th. sheet is jammed along the second conveyance path, stopping a conveyance of the (N+1) th sheet without permitting the (N+1)th sheet to be stacked on the first stacking section.

23. The image forming method of claim 22, further comprising the step of, after clearing of the jammed sheet, restarting image formation from an image corresponding to the N-th and subsequent sheets, whereby the N-th sheet is stacked on the second stacking section and the (N+1)th sheet is stacked on the first stacking section.

24. An image forming method used in an image forming system comprising: an image forming section for forming an image on a sheet; a first stacking section for stacking the sheet with the image formed thereon by the image forming section; a second stacking section provided at a position different from the first stacking section for stacking the sheet with the image formed thereon by the image forming section; a common conveyance path for conveying the sheet with the image formed thereon by the image forming section; a first conveyance path for conveying the sheet conveyed along the common conveyance path, to the first stacking section; a second conveyance path longer than the first conveyance path to guide the sheet conveyed along the common conveyance path, to the second stacking section, wherein an interval between adjoining sheets fed along the common conveyance path is smaller than a difference between the second and first conveyance paths, when images are formed on the sheets continuously one by one by the image forming section; and a switching section for switching a conveyance path of the sheet conveyed along the common conveyance path between the first conveyance path and the second conveyance path, and when images are formed on continuous N-th sheet and (N+1)th sheet, and the switching section is selected such that the N-th sheet is fed along the second conveyance path and the (N+1)th sheet is fed along the first conveyance path, where N represents a natural number, the image forming method comprising the steps of:

restarting image formation from an image corresponding to the N-th and subsequent sheets, except for an image which has been formed on the (N+1)th sheet and ejected to the first stacking section, after the N-th sheet has been jammed along the second conveyance path and has been cleared; and conveying a sheet with an image corresponding to the N-th sheet formed thereon to the second conveyance path by the switching section.

25. The image forming method of claim 24, further comprising the steps of, when the N-th sheet is jammed along the second conveyance path and a sheet with an image which has been formed thereon is included in the (N+1)th and subsequent sheets, ejecting the sheet included in the (N+1)th and subsequent sheets to the first stacking section not to be left along the common conveyance path and the first conveyance path; and then stopping the image formation.

26. The image forming method of claim 24, further comprising the steps of, when the switching section is selected such that the N-th sheet is fed along the second conveyance path and the (N+1)th sheet is fed along the first conveyance path, and when the N-th sheet is jammed along the second conveyance path, and M sheets on which images have been formed are ejected to the first stacking section until the image formation is stopped, and after the jammed N-th sheet is cleared, restarting the image formation from an image corresponding to the N-th sheet and an (N+M+1)th and subsequent sheets;

conveying the sheet with an image corresponding to the N-th sheet formed thereon to the second conveyance path; and conveying sheets with an image corresponding to the (N+M+1)th and subsequent sheets to the first conveyance path.

27. The image forming method of claim 15, further comprising the step of making an interval between the N-th sheet and the (N+1)th sheet to be different between the time when the switching section is selected in such a way that the N-th sheet with an image formed thereon is fed along the second conveyance path and (N+1)th sheet is fed along the first conveyance path during continuous image forming operation, and the time when the switching section is selected in such a way that the N-th sheet is fed along the first conveyance path and (N+1)th sheet is fed along the second conveyance path during continuous image forming operation.

28. The image forming method of claim 15, further comprising the step of, when images are continuously formed on each of sheets by the image forming section, and the switching section is selected to ensure that the sheets up to the N-th sheet with each image formed thereon and the (N+1)th and subsequent sheets with each image formed thereon are fed to different stacking sections, making an interval between the N-th sheet and (N+1)th sheet is greater than that when sent to the same stacking section.

* * * * *